US010305232B2

(12) United States Patent
Urashima et al.

(10) Patent No.: US 10,305,232 B2
(45) Date of Patent: May 28, 2019

(54) CONNECTOR HOUSING AND CONNECTOR UNIT

(71) Applicant: Yazaki Corporation, Minato-ku, Tokyo (JP)

(72) Inventors: Tomohiro Urashima, Utsunomiya (JP); Masashi Nakamura, Utsunomiya (JP); Yoshiharu Ishii, Utsunomiya (JP); Hiroyuki Sasaki, Utsunomiya (JP); Kenji Nemoto, Utsunomiya (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/878,018

(22) Filed: Jan. 23, 2018

(65) Prior Publication Data

US 2018/0219336 A1 Aug. 2, 2018

(30) Foreign Application Priority Data

Jan. 27, 2017 (JP) ..... 2017-013565
Jun. 1, 2017 (JP) ..... 2017-109219

(51) Int. Cl.

| | |
|---|---|
| ***H01R 13/60*** | (2006.01) |
| ***H01R 13/73*** | (2006.01) |
| ***H01R 13/514*** | (2006.01) |
| ***H01R 13/518*** | (2006.01) |

(52) U.S. Cl.

CPC ..... *H01R 13/73* (2013.01); *H01R 13/514* (2013.01); *H01R 13/518* (2013.01); *H01R 13/60* (2013.01)

(58) Field of Classification Search

CPC .... H01R 13/518; H01R 13/73; H01R 13/514; H01R 13/60; F16L 3/3233; G09F 7/18; F16B 2/26

USPC ..... 248/74.2–74.3, 219.4, 229.17, 228.8, 248/230.8; 439/575, 717, 574, 527

See application file for complete search history.

(56) References Cited

U.S. PATENT DOCUMENTS 5,799,916 A * 9/1998 Lechner ..... F16L 1/24 114/267
5,833,188 A * 11/1998 Studdiford ..... B62J 11/00 248/229.17
6,162,092 A * 12/2000 Lin ..... H01R 13/6392 439/574
6,330,989 B1 * 12/2001 Okamoto ..... B62J 11/00 24/16 R (Continued)

FOREIGN PATENT DOCUMENTS

CN 101364685 A 2/2009
CN 102171892 A 8/2011

(Continued)

OTHER PUBLICATIONS

Mar. 1, 2019—(CN) The First Office Action—App 201810082647.1.

*Primary Examiner* — Gary F Paumen
(74) *Attorney, Agent, or Firm* — Banner & Witcoff, Ltd.

(57) ABSTRACT

A connector housing includes a cylindrical side wall. The cylindrical side wall includes a concave surface on one side of an outer circumferential surface of the cylindrical side wall in a first direction. The concave surface curves inwards into an arc shape and extends in a second direction, so that the concave surface is to be pressed against a cylindrical member with the second direction aligned with a direction in which the cylindrical member extends.

7 Claims, 38 Drawing Sheets

(56) References Cited

U.S. PATENT DOCUMENTS

| | | | | |
|---|---|---|---|---|
| 7,806,720 | B2 * | 10/2010 | Omori | H01R 9/03 439/507 |
| 7,997,546 | B1 * | 8/2011 | Andersen | F16B 2/08 248/214 |
| 2008/0164383 | A1 * | 7/2008 | Gunzburger | B60R 16/0215 248/74.3 |
| 2009/0042445 | A1 | 2/2009 | Ichio et al. | |
| 2010/0144193 | A1 * | 6/2010 | Omori | H01R 9/03 439/507 |
| 2010/0221959 | A1 | 9/2010 | Pan | |
| 2011/0189882 | A1 | 8/2011 | Sakamoto | |
| 2014/0263874 | A1 * | 9/2014 | DeCesare | F16L 3/04 248/74.2 |

FOREIGN PATENT DOCUMENTS

| | | | |
|---|---|---|---|
| CN | 103959570 | A | 7/2014 |
| JP | 2009-170289 | A | 7/2009 |
| WO | 2013031201 | A1 | 3/2013 |

* cited by examiner

CONNECTOR HOUSING AND CONNECTOR UNIT

CROSS-REFERENCES TO RELATED APPLICATIONS

This application is based on and claims priority from Japanese Patent Applications No. 2017-013565 filed on Jan. 27, 2017 and No. 2017-109219 filed on Jun. 1, 2017, the entire contents of which are incorporated herein by reference.

BACKGROUND

1. Field of the Invention

The present invention relates to a connector housing and a connector unit.

2. Description of Related Art

JP-A-2009-170289 discloses a connector housing in which the connector housing is fixed to an outer circumferential surface of a bundle of electric wires by winding a tape around the outer circumferential surface of the bundle of electric wires and an outer circumferential surface of the connector housing so as to cover them altogether while the outer circumferential surface of the connector housing is kept in contact with the outer circumferential surface of the bundle of electric wires.

In the connector housing described in JP-A-2009-170289, a rib projecting outwards is provided on a side wall on an opposite side to the side with which the bundle of electric wires is brought into contact, and the tape is wound around the bundle of electric wires and the connector housing along the rib. This can prevent the tape from being wound around out of place.

JP-A-2009-170289 discloses that the connector housing is fixed to the outer circumferential surface of the bundle of electric wires disposed in an interior of a cylindrical corrugated pipe (hereinafter, also will be referred to as a cylindrical member from time to time). Although JP-A-2009-170289 does not disclose, the connector housing may be considered to be fixed to an outer circumferential surface of the cylindrical member. As this occurs, the cylindrical member, which is harder than the bundle of electric wires, is not deformed to follow the configuration of the connector housing to such an extent that the bundle of electric wires is even though the connector housing is disposed to be pressed against the outer circumferential surface of the cylindrical member. This prevents the posture of the connector housing from being stabilized relative to the cylindrical member even though the connector housing is pressed against the outer circumferential surface of the cylindrical member. Thus, it is not easy to fix the connector housing to the cylindrical member while being kept in an appropriate posture.

SUMMARY

In accordance with embodiments, a connector housing and a connector unit are provided. According to the embodiments, the connector housing and the connector unit can easily be fixed to a cylindrical member while being kept in an appropriate posture even in the case where the connector housing and the connector unit are disposed on an outer circumferential surface of the cylindrical member.

In accordance with embodiments, a connector housing includes a cylindrical side wall. The cylindrical side wall includes a concave surface on one side of an outer circumferential surface of the cylindrical side wall in a first direction. The concave surface curves inwards into an arc shape and extends in a second direction, so that the concave surface is to be pressed against a cylindrical member with the second direction aligned with a direction in which the cylindrical member extends.

In accordance with embodiments, a connector unit includes a first connector housing, a second connector housing, and a connecting member configured to fix the first connector housing and the second connector housing together in a condition where the ribs formed on said another side of the second connector housing placed in the cut-outs formed on said one side of the first connector housing.

Other aspects and advantages of the invention will be apparent from the following description and the appended claims.

DETAILED DESCRIPTION

Connector housings according to exemplary embodiments will be described by reference to the drawings.

<First Embodiment>

Referring to FIGS. 1 to 5, a connector housing 10 according to a first embodiment will be described.

A resin connector housing 10 is a housing of a joint connector into which a housing (whose illustration is omitted) of a mating connector is fitted. This connector housing 10 is fixed to an outer circumferential surface of a cylindrical member referred to as a corrugated tube or a corrugated pipe for use. The joint connector includes joint terminals configured to be connected commonly to a plurality of terminals accommodated in the housing of the mating connector and has a function to short circuit the plurality of terminals of the fitted mating connector. Such joint connectors include a joint connector in which a terminal attached to a leading end of an electric wire is inserted directly thereinto without involving the aforesaid mating connector, and the embodiment may also be applied to this type of joint connector. More particularly, the embodiment may be applied not only to the joint connectors but also to a general connector for connecting electric wires together.

Figure 1:
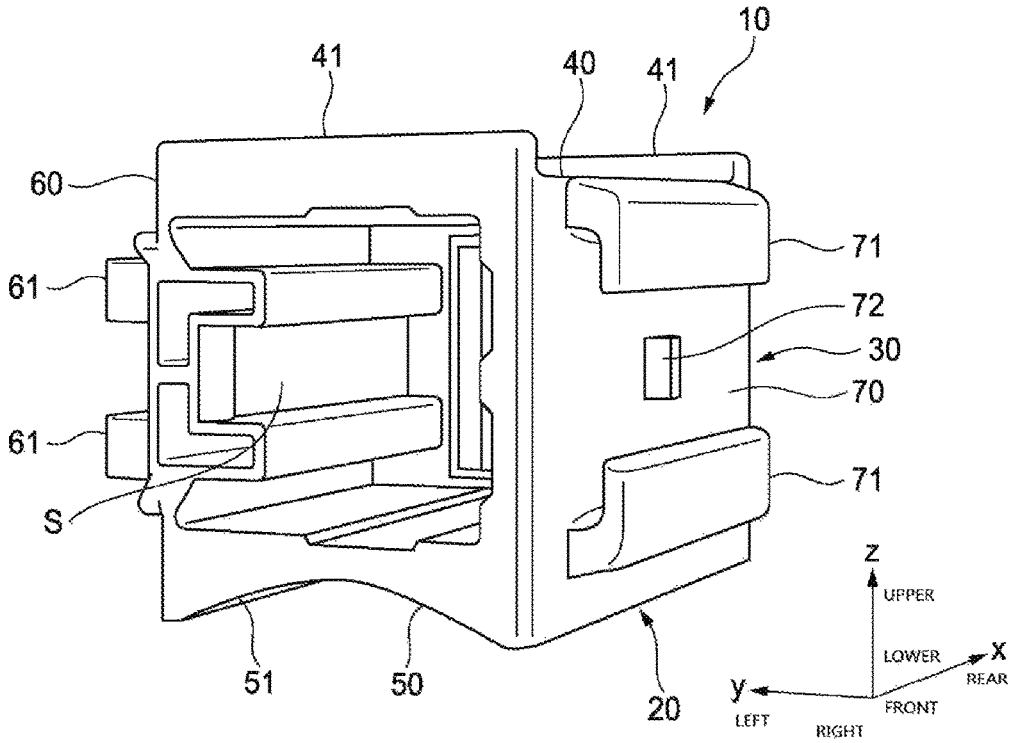
FIG. 1 is a perspective view of a connector housing according to a first embodiment.

Hereinafter, as a matter of convenience in description, an x-axis direction (a front-and-rear or longitudinal direction), a y-axis direction (a left-and-right or transverse direction), a z-axis direction (an up-and-down or vertical direction), front, rear, left, right, top and bottom are defined as shown in FIG. 1. The front-and-rear direction, the left-and-right direction and the up-and-down direction intersect one another at right angles.

Figure 2:
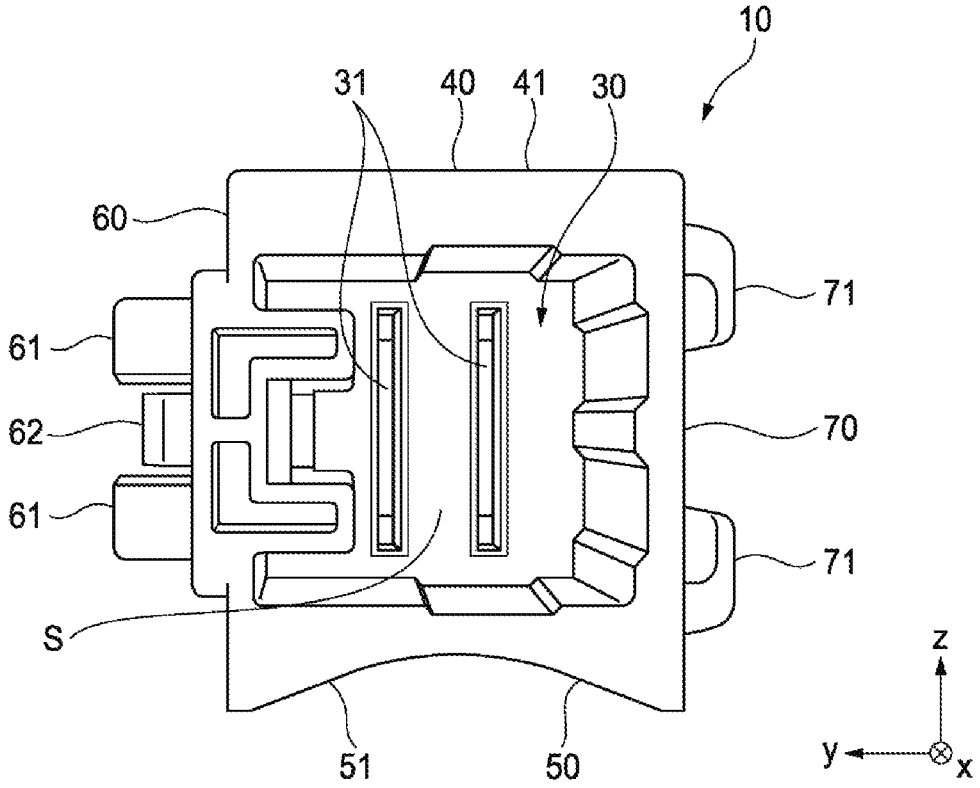
FIG. 2 is a front view of the connector housing shown in FIG. 1.
Figure 3:
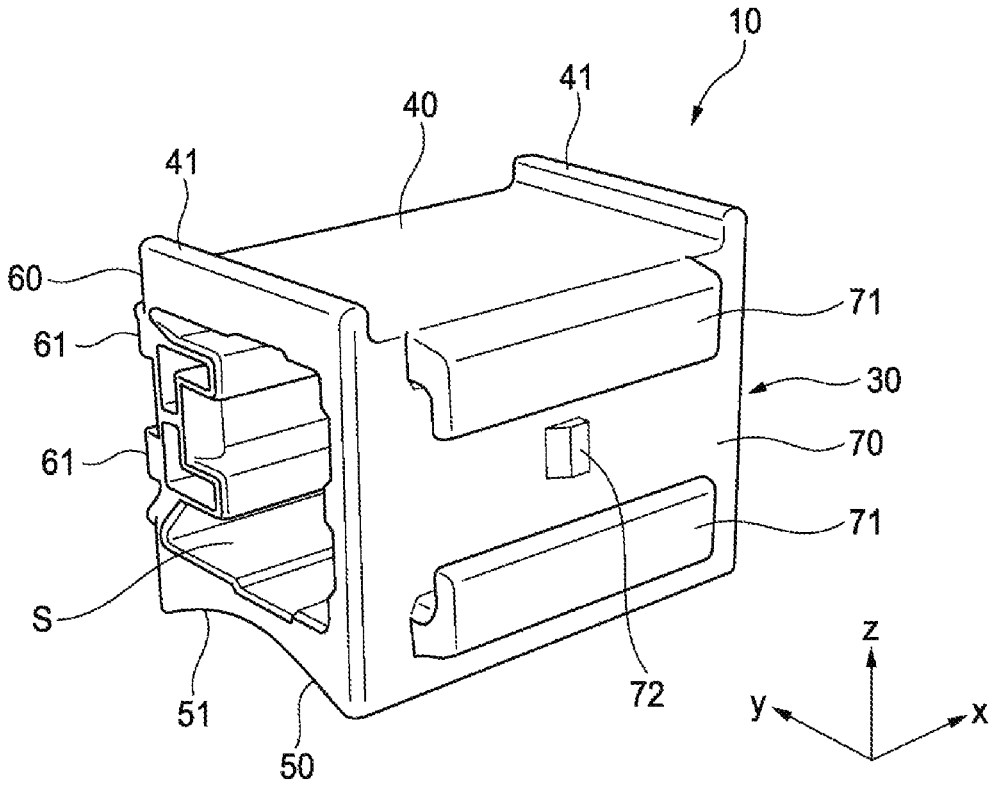
FIG. 3 is a perspective view of the connector housing shown in FIG. 1 as seen from thereabove.

As shown in FIGS. 1 to 3, the connector housing 10 includes an angularly cylindrical side wall 20 that extends in the front-and-rear direction and a rear wall 30 that connects to the side wall 20 so as to close an opening at a rear end portion of the side wall 20. The connector housing 10 has a box shape in which an interior space S is defined. A housing of a mating connector is inserted into the interior space S by way of an opening at a front end portion of the side wall 20 to thereby be fitted into the connector housing 10.

The side wall 20 includes a top wall 40, a bottom wall 50, a left wall 60, and a right wall 70. As shown in FIG. 3, a pair of parallel ribs 41 are formed at front and rear end portions of an outer circumferential surface (an external surface) of the top wall 40. The pair of ribs 41 project upwards from the top wall 40 and extend across a whole transverse area of the top wall 40 in the left-and-right direction. As will be described later, the pair of ribs 41 function to prevent a tape T from being wound around out of place when the tape T is used to fix the connector housing 10 to a cylindrical corrugated tube C (also, referred to as a cylindrical member from time to time) (refer to FIG. 5B, which will be described later).

A concave surface 51 is formed on an outer circumferential surface (an external surface) of the bottom wall 50. This concave surface 51 curves inwards into an arc shape and extends across a whole longitudinal area of the bottom surface 50 in the front-and-rear direction. In the first embodiment, the concave surface 51 is made up of an arc portion having a single radius of curvature. As will be described later, the concave surface 51 constitutes a surface to be brought into contact with an outer circumferential surface of the corrugated tube C when the connector housing 10 is fixed to the corrugated tube C (refer to FIG. 5A, which will be described later). Consequently, a radius of curvature of the arc portion of the concave surface 51 is preferably designed to be equal to an outside diameter of the corrugated tube C that is brought into contact with the concave surface 51.

A pair of male through locks 61 extending in the front-and-rear direction are formed on an outer circumferential surface (an external surface) of the left wall 60, and a pair of female through locks 71 extending in the front-and-rear direction are formed on an outer circumferential surface (an external surface) of the right wall 70. The pair of male through locks 61 are allowed to fit into the pair of female through locks 71.

Thus, two such connector housings 10 can be connected fixedly together by fitting a pair of male through locks 61 on one connector housing 10 into a pair of female through locks 71 on the other connector housing 10 with the two connector housings 10 aligned side by side while being oriented in an identical direction so that the pair of male through locks 61 on the one connector housing 10 face the pair of female through locks 71 on the other connector housing 10.

With the two connector housings 10 connected and fixed together, a lock beak 62 (particularly, refer to FIG. 2) formed between the pair of male through locks 61 is brought into engagement with a projection 72 (particularly, refer to FIG. 3) formed between the pair of female through locks 71, whereby the pair of male through locks 61 are prevented from being dislocated (separated) from the pair of female through locks 71.

As shown, in particular, in FIG. 2, a pair of slits 31 extending in the up-and-down direction are formed in the rear wall 30. The joint terminals (not shown) are inserted into the pair of slits 31 to be fixed therein. Mounting the joint terminals on the connector housing 10 in the way described above allows the connector housing 10 to function as the housing of the joint connector as described above.

Figure 4:
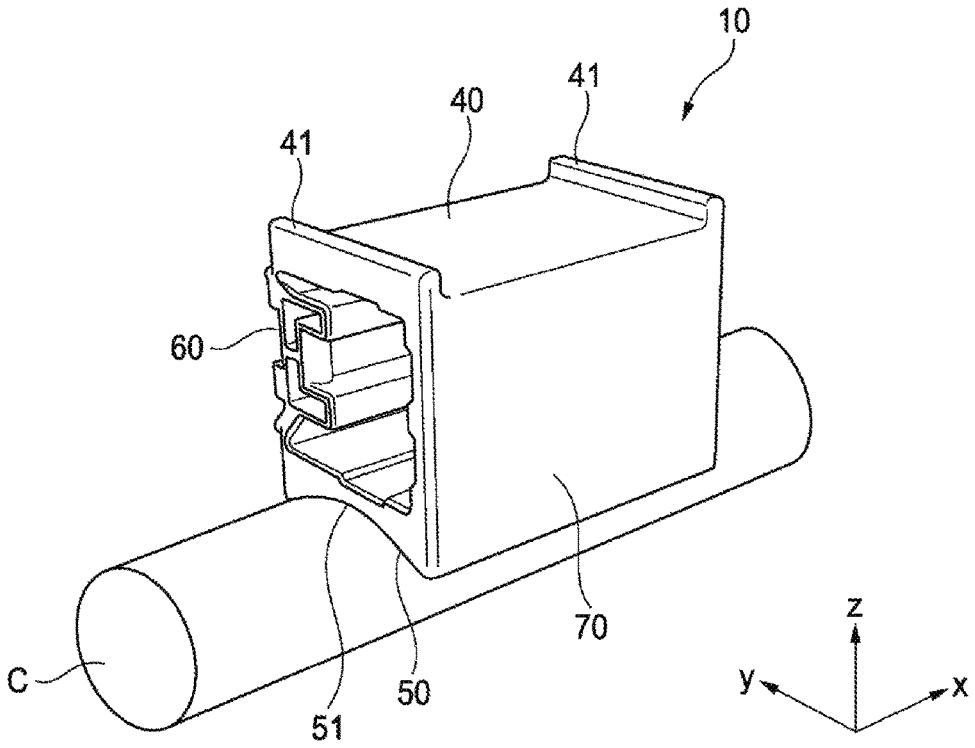
FIG. 4 is a perspective view showing a state in which a concave surface of the connector housing shown in FIG. 1 is pressed against a corrugated tube.

As shown in FIGS. 4 to 5, the connector housing 10 is fixed to an outer circumferential surface of the corrugated tube for use. A procedure of fixing the connector housing 10 to the outer circumferential surface of the corrugated tube C will be described below.

Figure 5A:
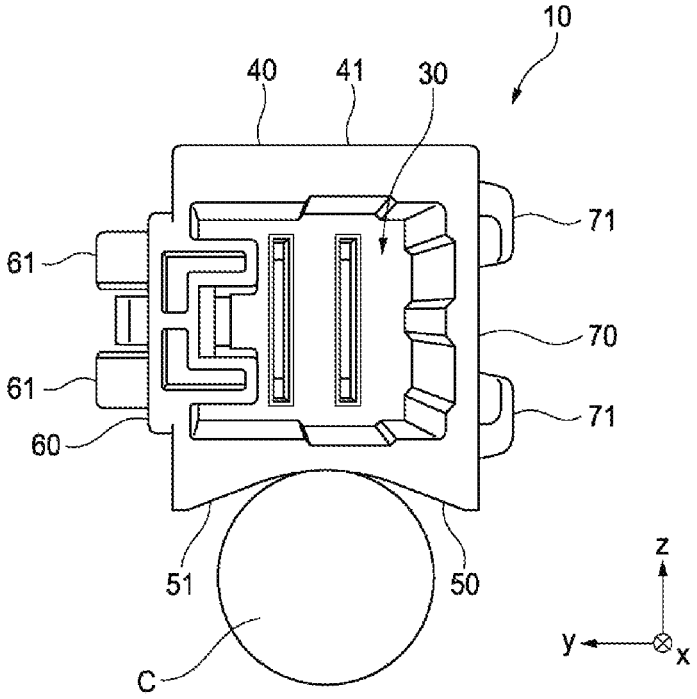
FIG. 5A is a front view showing the state shown in FIG. 4.

As shown in FIGS. 4 and 5A, firstly, the connector housing 10 is disposed on the corrugated tube C to which the connector housing 10 is to be fixed in a predetermined position along a direction in which the corrugated tube C extends so that a longitudinal direction of the connector housing 10 follows the extending direction of the corrugated tube C, and the concave surface 51 of the bottom wall 50 of the connector housing 10 is pressed against the corrugated tube C.

This allows the connector housing 10 to take an appropriate posture relative to the corrugated tube C, that is, a posture in which the connector housing 10 does not deviate in the left-and-right direction from an axis of the corrugated tube C. Even in the case where the extending direction of the corrugated tube C deviates slightly from the longitudinal direction of the connector housing 10 partially or totally before the connector housing 10 is pressed against the corrugated tube C, a portion of the corrugated tube C that is pressed against the concave surface 51 is allowed to extend straight in the longitudinal direction of the connector housing 10.

Figure 5B:
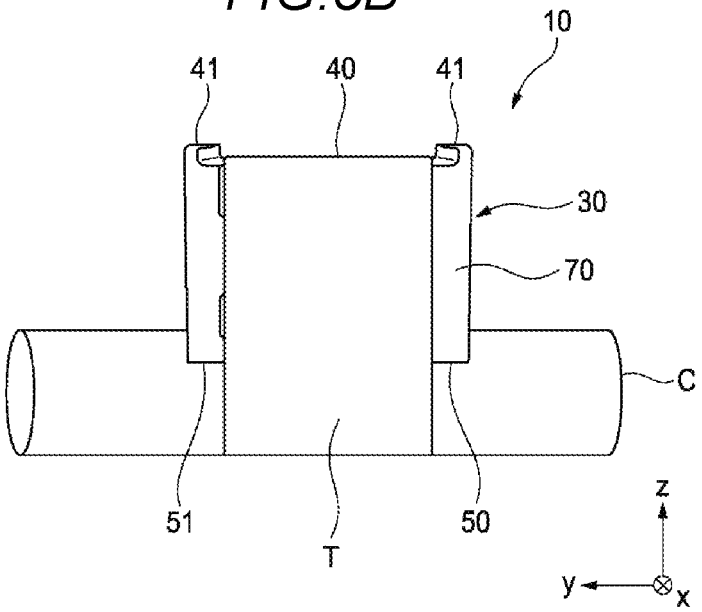
FIG. 5B is a side view showing a state in which the connector housing shown in FIG. 1 is fixed to the corrugated tube using a tape.
Figure 6:
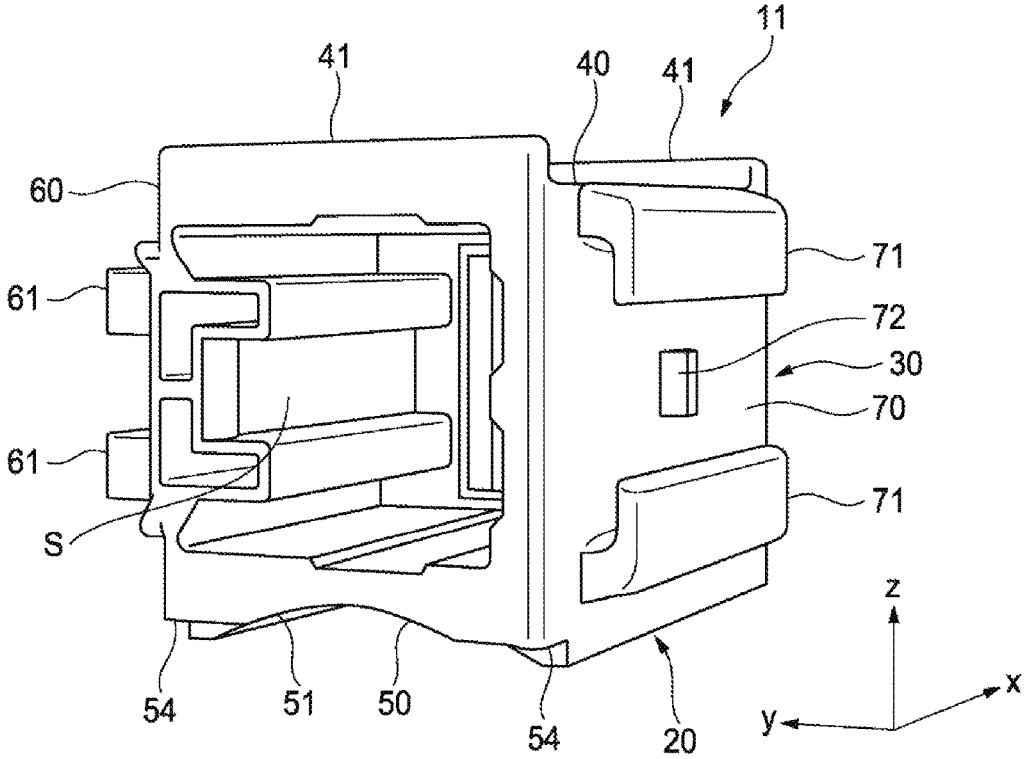
FIG. 6 is a perspective view of a connector housing according to a second embodiment.
Figure 7:
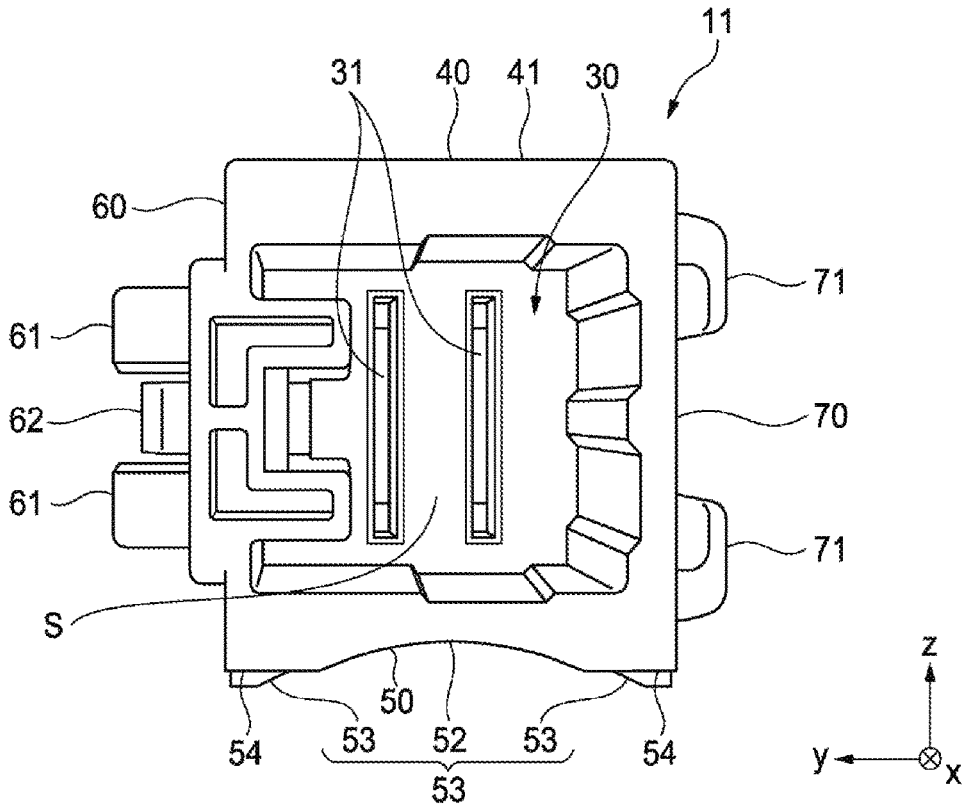
FIG. 7 is a front view of the connector housing shown in FIG. 6.

Next, the tape T is wound around the outer circumferential surface of the corrugated tube C and the outer circumferential surface of the side wall 20 of the connector housing 10 so as to cover them altogether while pressing the connector housing 10 against the corrugated tube C on the concave surface 51, as shown in FIG. 5B. As this occurs, the tape T is wound around so as to pass through an area defined between the pair of ribs 41 provided on the top wall 40.

As a result, the connector housing 10 can easily be fixed to the outer circumferential surface of the corrugated tube C in the appropriate posture in which the extending direction of the corrugated tube C follows the longitudinal direction of the connector housing 10. In winding the tape T around the connector housing 10 and the corrugated tube C, the tape T can easily be wound around based on the pair of ribs 41. In addition, as shown in FIG. 5B, a transverse deviation of the tape T (a deviation of the tape T in the longitudinal direction of the connector housing 10) is prevented by winding the tape T around the connector housing 10 and the corrugated tube C in such a way that the transverse end faces of the tape T lie near the ribs 41 (alternatively, the transverse end faces of the tape T come into contact with the ribs 41).

In the connector housing 10 according to the first embodiment, the concave surface 51 is formed on the outer circumferential surface of the bottom wall 50. Thus, even in the case where the connector housing 10 is disposed on the outer circumferential surface of the corrugated tube C, the connector housing 10 can be kept in the appropriate posture relative to the corrugated tube C by pressing the connector housing 10 against the corrugated tube C with the one direction in which the concave surface 51 extends aligned with the extending direction of the corrugated tube C. Pressing the corrugated tube C against the concave surface 51 can easily obtain the state in which the portion of the corrugated tube C that is pressed against the concave surface 51 extends straight in the longitudinal direction of the connector housing 10. The connector housing 10 can easily be fixed to the outer circumferential surface of the corrugated tube C in the appropriate posture in which the extending direction of the corrugated tube C coincides with the longitudinal direction of the connector housing 10 by winding the tape T around the outer circumferential surface of the corrugated tube C and the outer circumferential surface of the side wall of the connector housing 10 so as to cover them altogether in the state described above.

The pair of ribs 41 are formed on the top wall 40. In winding the tape T around the connector housing 10 and the corrugated tube C, the formation of the pair of ribs 41 enables the tape T to be wound around based on the pair of ribs 41, which prevents the tape T from being wound around out of place in the transverse direction thereof (in the longitudinal direction of the connector housing 10).

<Second Embodiment>

Referring to FIGS. 6 to 13, a connector housing 11 according to a second embodiment will be described. The connector housing 11 differs from the connector housing 10 according to the first embodiment in that a concave surface 51 of a bottom wall 50 includes a plurality of types of arc portions having different radii of curvature and that cut-outs 54 are provided in four corner portions of the concave surface 51. Hereinafter, these different features will be described in detail. FIGS. 14 to 22 are drawings (a perspective view 1, a perspective view 2, a front view, a rear view, a left side view, a right side view, a plan view, a bottom view and a reference drawing showing a state in which the connector housing 11 is in use) showing the connector housing 11 according to the second embodiment in greater detail, and the details of the embodiment is clarified further by reference to FIGS. 14 to 22.

Figure 8A:
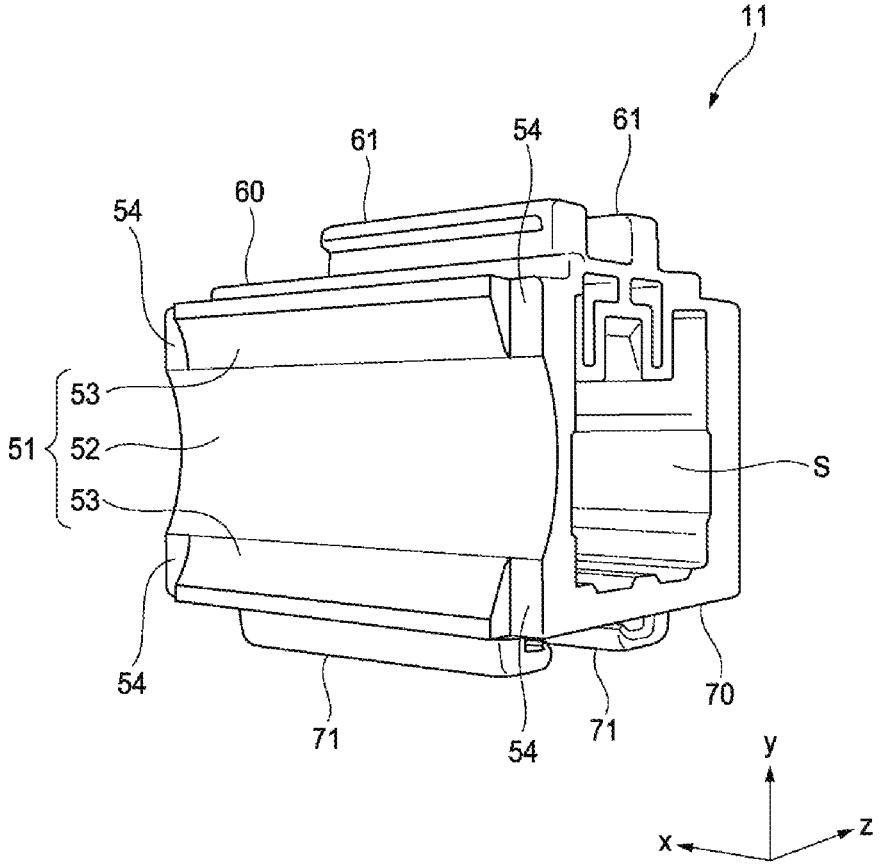
FIG. 8A is a perspective view of the connector housing shown in FIG. 6 as seen from therebelow.
Figure 8B:
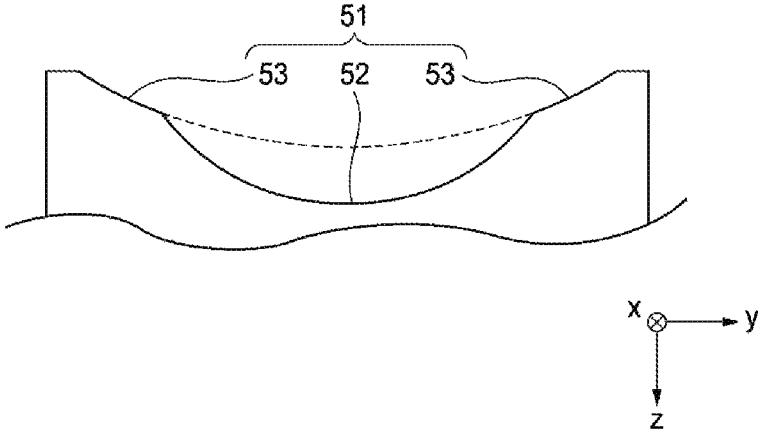
FIG. 8B is a drawing illustrating a detailed configuration of a concave surface formed on the connector housing.

As can be understood particularly from FIGS. 8A and 8B, the concave surface 51 on the bottom wall 50 of the connector housing 11 includes an arc portion 52 (also, referred to as a first arc portion from time to time) extending in the front-and-rear direction at a transverse central portion thereof and having a relatively small radius of curvature and a pair of left and right arc portions 53 (also, referred to as a second arc portion from time to time) extending in the front-and-rear direction at transverse outer sides of the arc portion 52 and having a relatively great radius of curvature. The arc portion 52 and the arc portions 53 are formed so that an outer circumferential surface of the former continues to outer circumferential surfaces of the latter.

This enables the connector housing 11 to be fixed to two types of corrugated tubes C having different outside diameters while kept in an appropriate posture even in the case where the connector housing 11 needs to be fixed to those two types of corrugated tubes C. Specifically, in the case where the connector housing 11 is fixed to a corrugated tube C having a relatively small outside diameter that is equal to the radius of curvature of the arc portion 52, an outer circumferential surface of the corrugated tube C is brought into contact with the arc portion 52 of the concave surface 51. On the other hand, in the case where the connector housing 11 is fixed to a corrugated tube C having a relatively great outside diameter that is equal to the radius of curvature of the arc portions 53, an outer circumferential surface of the corrugated tube C is brought into contact with the pair of left and right arc portions 53 of the concave surface 51.

In addition, as can be understood from FIG. 8A, the cut-outs 54 are formed in the four corner portions of the concave surface 51 of the bottom wall 50 of the connector housing 11 by cutting longitudinal end portions of the arc portions 53. Bottom surfaces of the cut-outs 54 constitute a common flat surface that extends parallel to the front-and-rear and left-and-right directions (parallel to an x-y plane).

Figure 9:
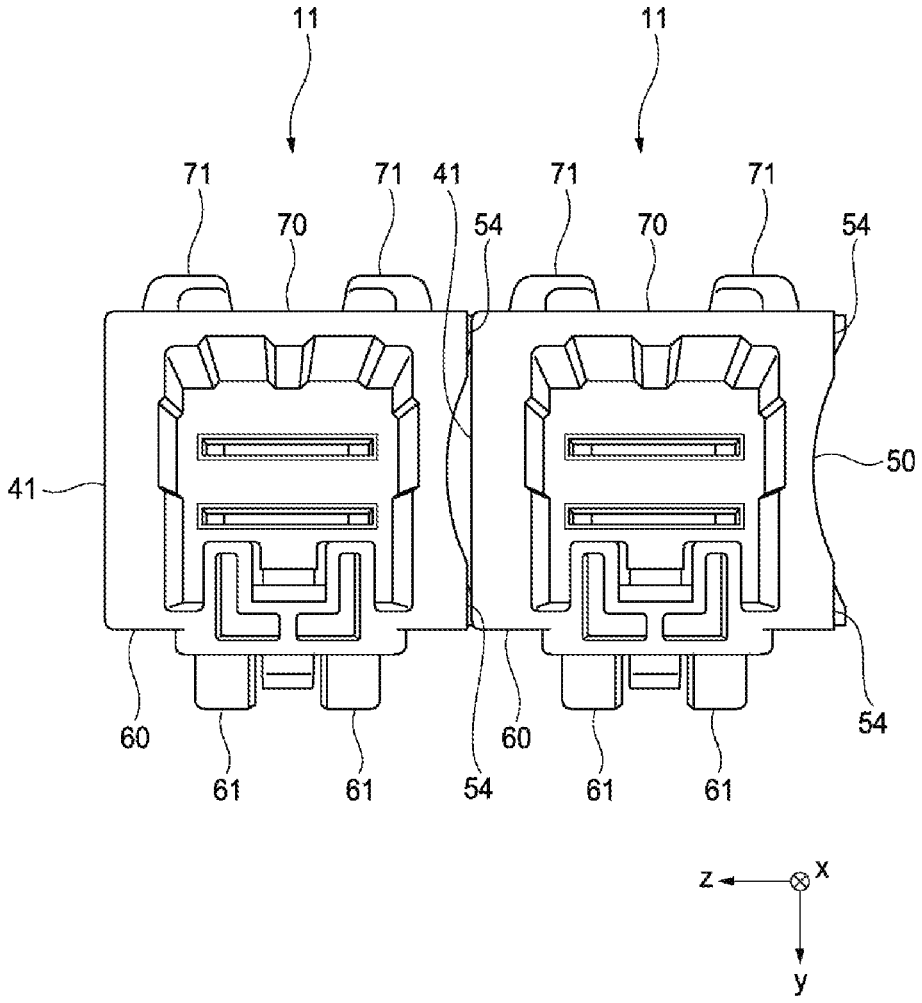
FIG. 9 is a front view of two connector housings like the connector housing shown in FIG. 6 showing a state in which the two connector housings are aligned side by side while being oriented in an identical direction so that ribs on one connector housing are placed in cut-outs on a concave surface on the other connector housing.

As shown in FIG. 9, the cut-outs 54 are formed in positions where end portions of the corresponding ribs 41 can enter the cut-outs 54 when two connector housings 11 are aligned side by side in an identical direction in such a way that a concave surface 51 of one connector housing 11 faces ribs 41 of the other connector housing 11.

Due to this, assembling and disposing the two connector housings 11 side by side in a row while directing them in the identical direction so that the ribs 41 on the one connector housing 11 of the adjacent two connector housings are placed in the cut-outs 54 on the concave surface 51 of the other connector housing 11 as shown in FIG. 9 can reduce the resulting height (a transverse dimension in FIG. 9) of the assembled connector housings 11 more than when no such cut-outs 54 are provided. This can reduce a space to be occupied by the whole of the plurality of connector housings 11 when the plurality of connector housings 11 are assembled to a vehicle body or an electrical junction box of a vehicle while being assembled and disposed side by side in a row while being oriented in the identical direction.

Figure 10A:
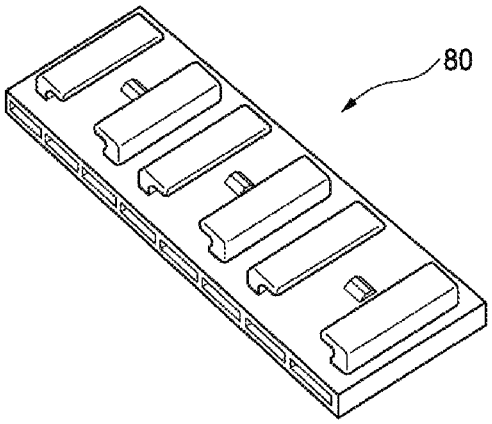
FIG. 10A is a perspective view of a connecting plate.
Figure 10B:
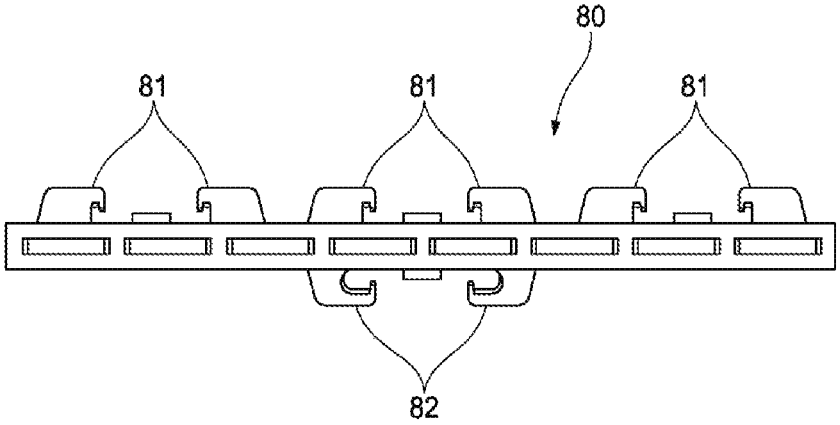
FIG. 10B is a front view of the connecting plate.
Figure 11:
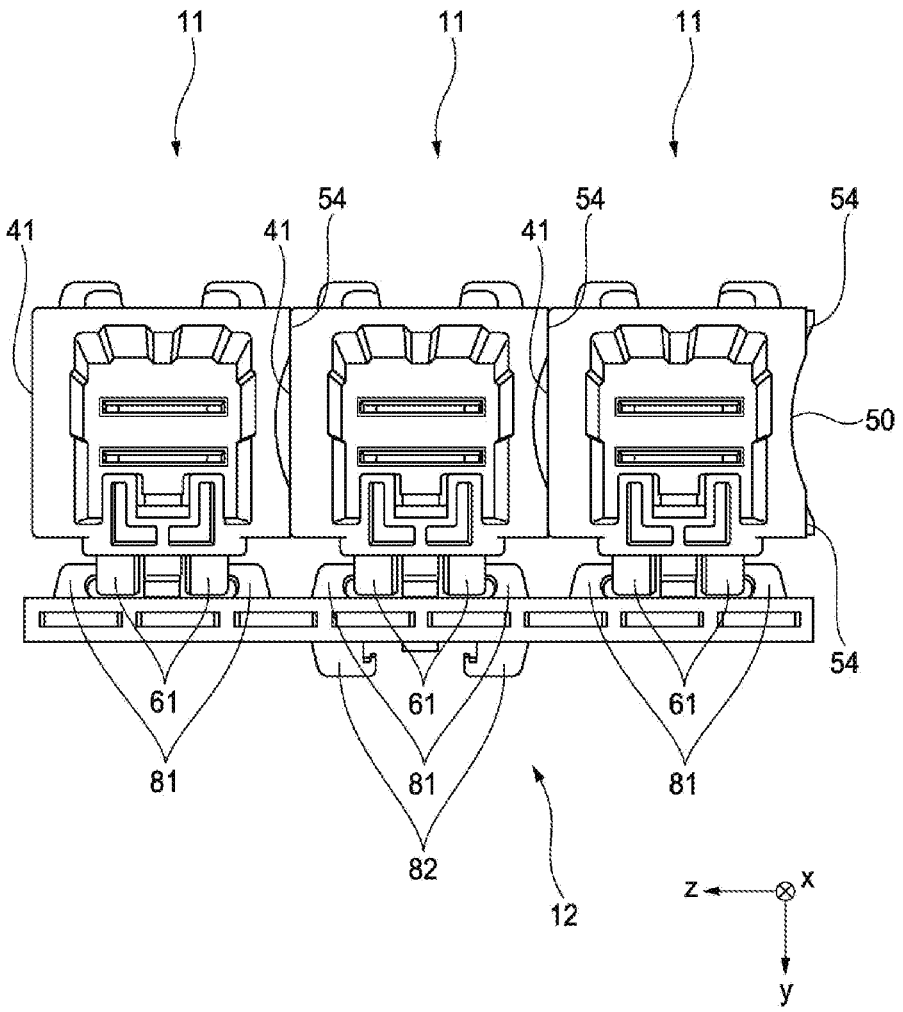
FIG. 11 is a front view of a connected connector housing in which a plurality of connector housings like the connector housing shown in FIG. 6 are connected together with the connecting plate.

The plurality of connector housings 11 that are assembled and disposed side by side in a row while being oriented in the identical direction as shown in FIG. 9 can constitute a connected connector housing 12 (also, referred to as a connector unit from time to time) in which connector housings 11 are connected together as shown in FIG. 11 by the use of a connecting plate 80 shown in FIG. 10.

As shown in FIG. 10, the connecting plate 80 is a resin plate-like member having a certain length. Pairs of through locks 81 are provided in a row on one side surface of the connecting plate 80 at a plurality of locations (three locations in the second embodiment) that are spaced apart from one another in a longitudinal direction at equal intervals. Each of the pairs of through locks 81 has the same shape as that of a pair of female through locks 71 (refer to FIG. 7 and the like) of the connector housing 11. A pair of through locks 82 is provided at a longitudinally central portion on the other side surface of the connecting plate 80. The pair of through locks 82 has the same or similar shape as or to that of the pair of through locks 81.

With the plurality of connector housings 11 assembled and disposed side by side while being oriented in the identical direction as shown in FIG. 9, fitting pairs of male through locks 61 of the connector housings 11 into the corresponding pairs of through locks 81 of the connecting plate 80 can obtain the connected connector housing 12 as shown in FIG. 11. The pair of through locks 82 of the connecting plate 80 can be used, for example, when the connected connector housing 12 is assembled to the vehicle body or the electrical junction box.

Figure 12A:
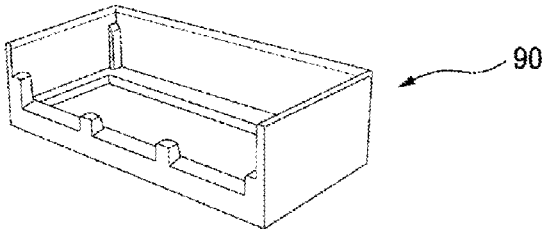
FIGS. 12A to 12C are drawings showing a first half of a procedure of assembling the plurality of connector housings into the connected housing using a connecting jig.

In assembling the connector housings 11 into the connected connector housing 12 as shown in FIG. 11, it is convenient to use a connecting jig 90 as shown in FIGS. 12 to 13. As shown in FIG. 12A, the connecting jig 90 is a resin box-like member that is opened at a top and has a certain length.

Figure 12B:
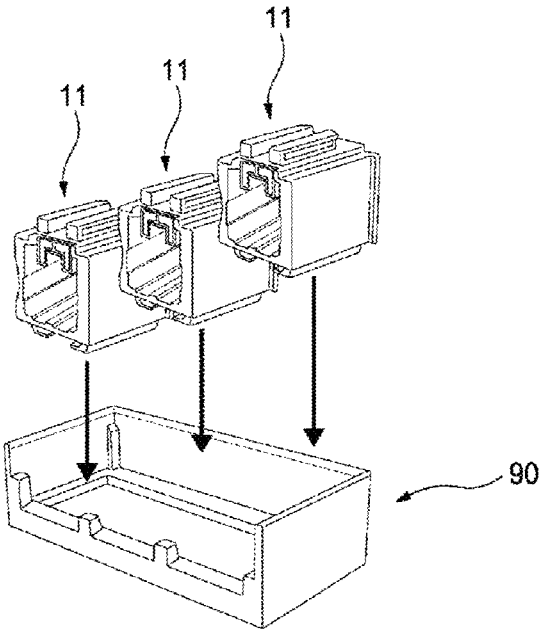
Figure 12C:
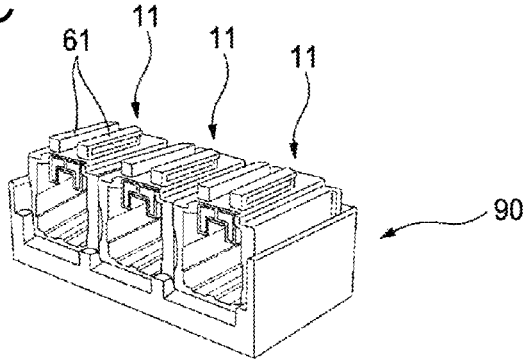

As shown in FIGS. 12B and 12C, a plurality of (three in the second embodiment) connector housings 11 that are disposed side by side in a row while being oriented in an identical direction as shown in FIG. 9 are accommodated in an interior space of the connecting jig 90 with pairs of male through locks 61 formed thereon oriented upwards. This allows side walls of the connecting jig 90 to cover the plurality of connector housings 11 to thereby fix the plurality of connector housings 11 so as not to move relative to one another with the pairs of male through locks 61 thereof oriented upwards.

Figure 13A:
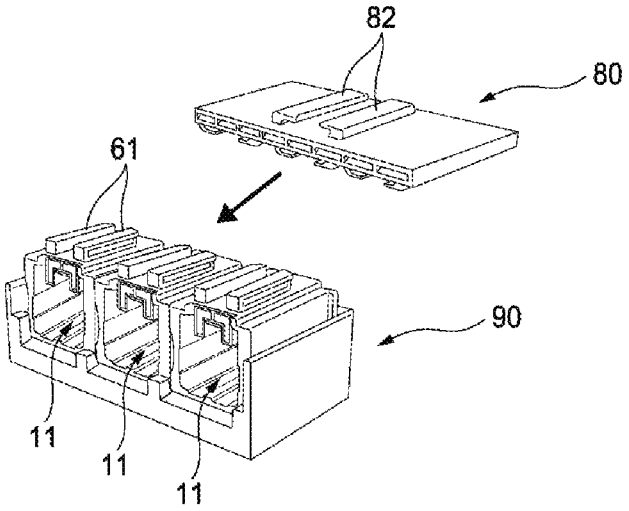
FIGS. 13A to 13C are drawings showing a second half of the procedure of assembling the plurality of connector housings into the connected housing using the connecting jig.
Figure 13B:
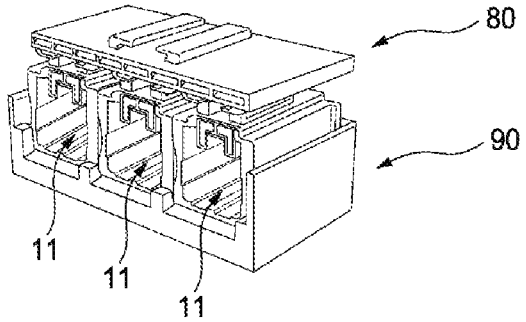
Figure 13C:
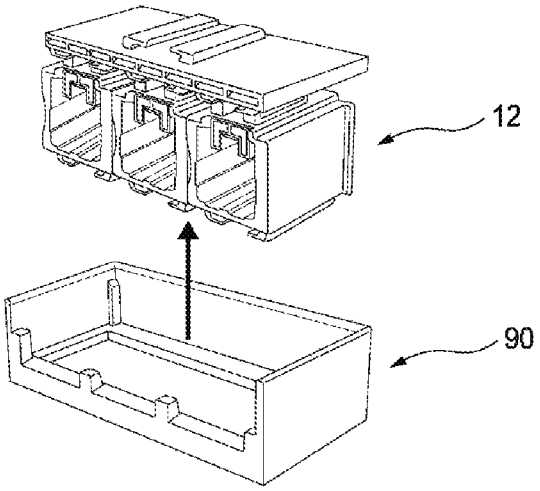
Figure 14:
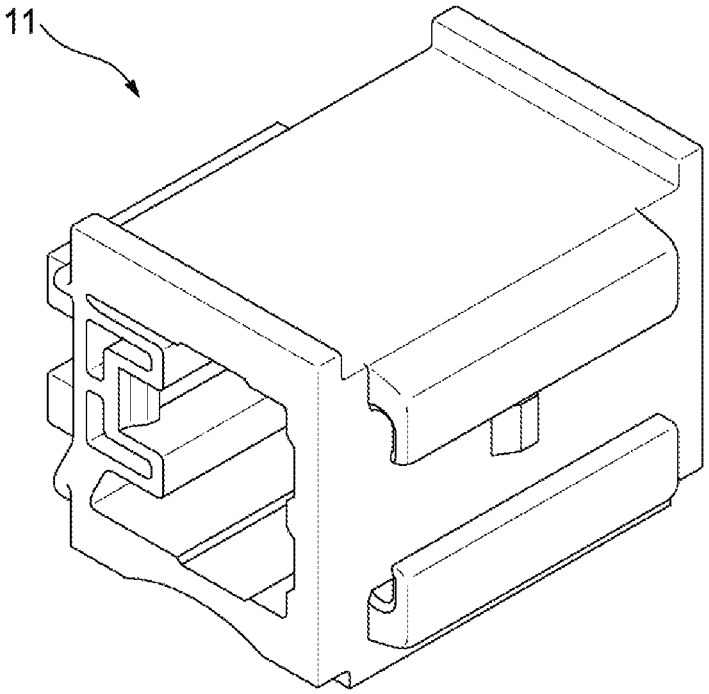
FIG. 14 is a perspective view 1 of the connector housing according to the second embodiment.
Figure 15:
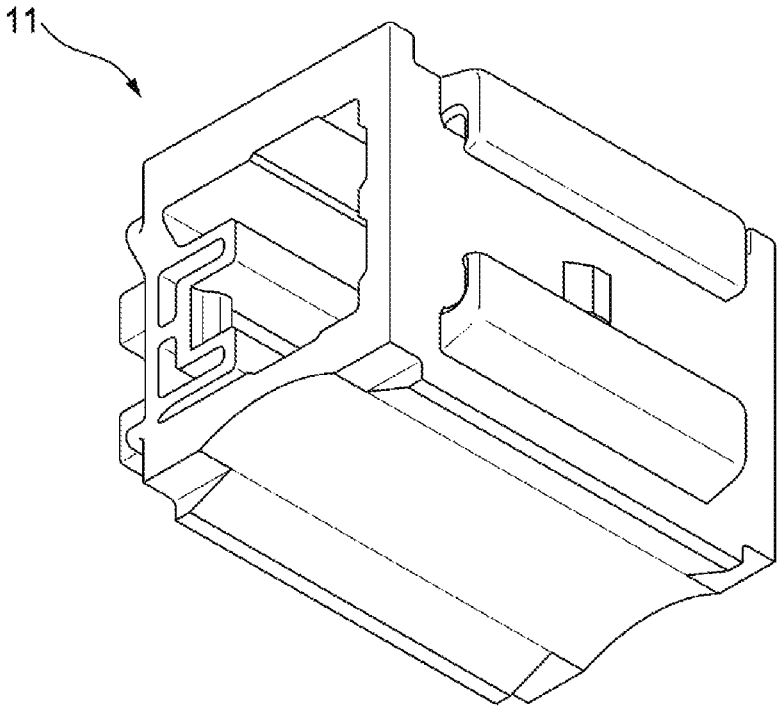
FIG. 15 is a perspective view 2 of the connector housing according to the second embodiment.
Figure 16:
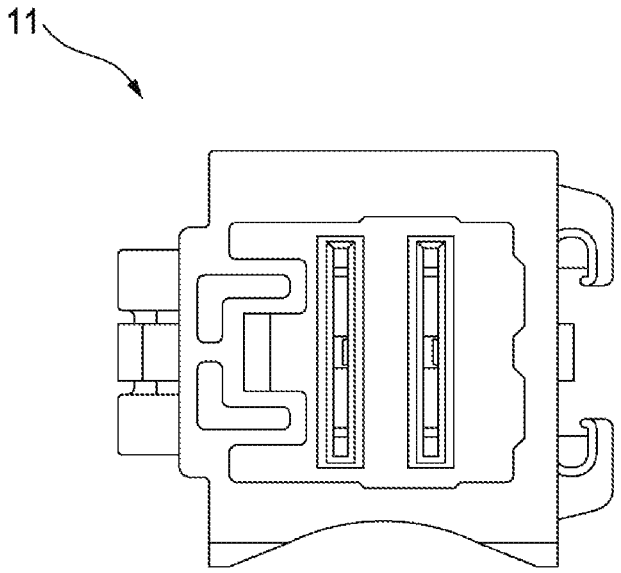
FIG. 16 is a front view of the connector housing according to the second embodiment.
Figure 17:
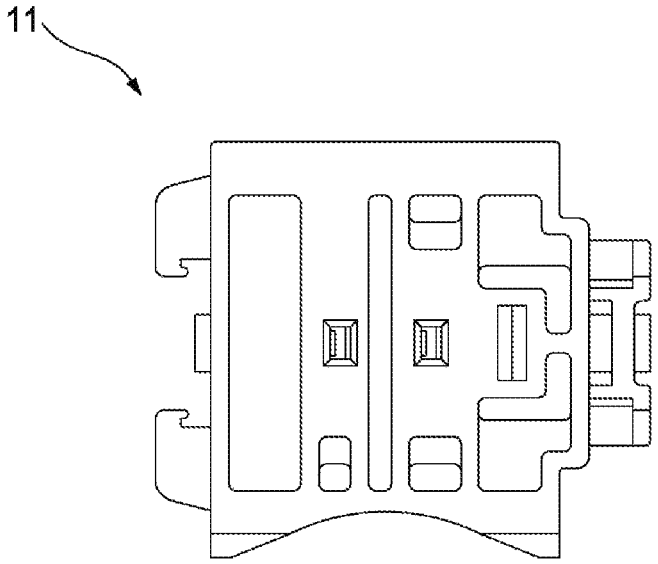
FIG. 17 is a rear view of the connector housing according to the second embodiment.
Figure 18:
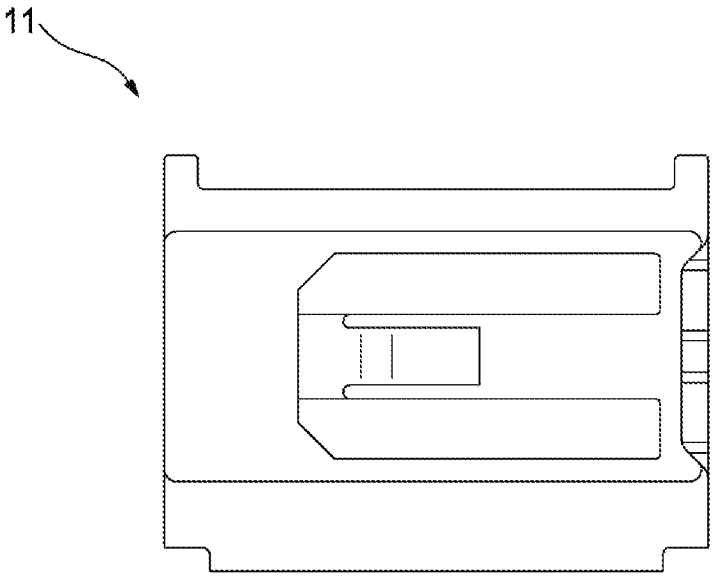
FIG. 18 is a left side view of the connector housing according to the second embodiment.
Figure 19:
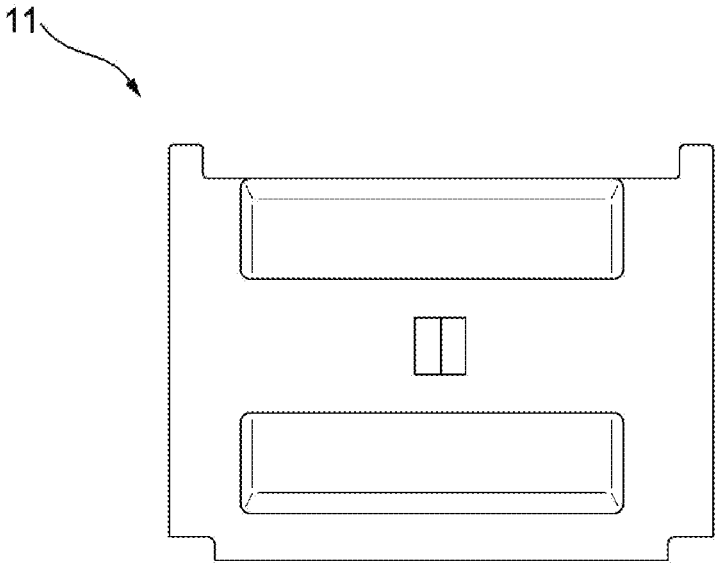
FIG. 19 is a right side view of the connector housing according to the second embodiment.
Figure 20:
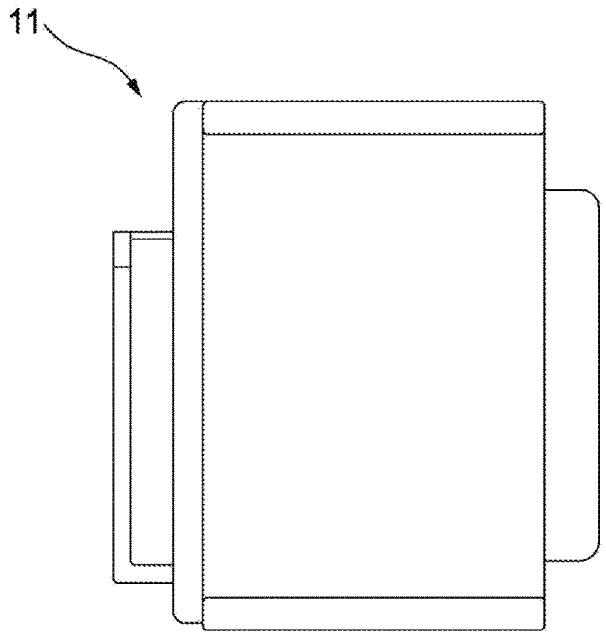
FIG. 20 is a plan view of the connector housing according to the second embodiment.
Figure 21:
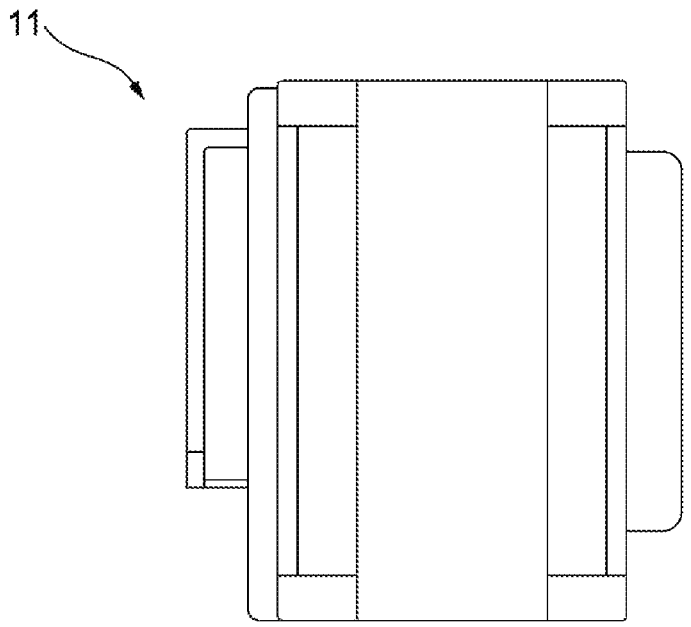
FIG. 21 is a bottom view of the connector housing according to the second embodiment.
Figure 22:
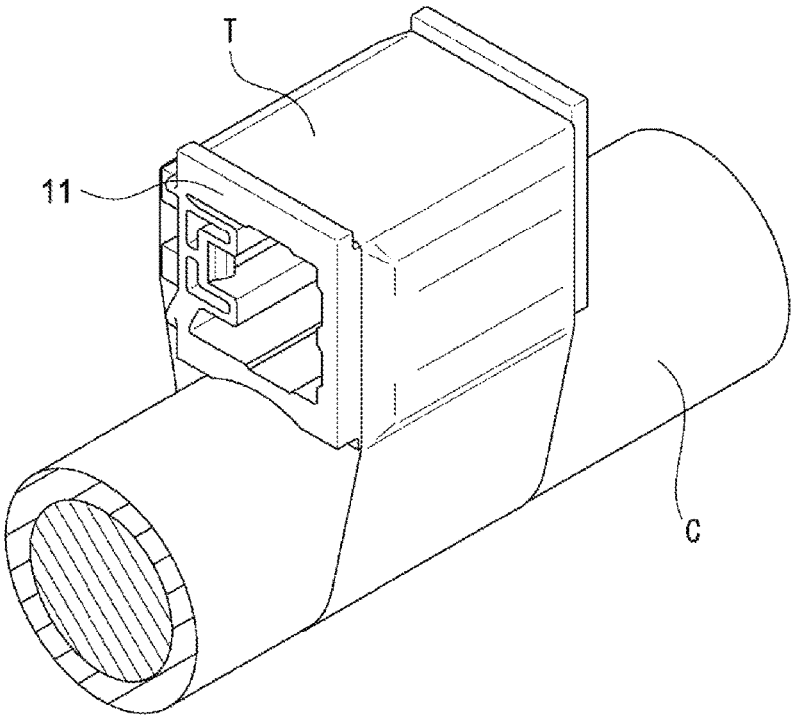
FIG. 22 is a reference drawing showing a state in which the connector housing according to the second embodiment is in use.

In this state, the pairs of through locks 81 of the connecting plate 80 are fitted into the corresponding pairs of male through locks 61 on the connector housings 11 as shown in FIGS. 13A and 13B, whereafter the connecting jig 90 is removed as shown in FIG. 13C. As a result, the connected connector housing 12 can easily be obtained.

In the connector housing 11 according to the second embodiment, the concave surface 51 of the bottom wall 50 includes the arc portion 52 and the arc portions 53 that have the different radii of curvature. This enables the connector housing 11 to keep the appropriate posture to the plurality of types of corrugated tubes C having the different outside diameters even in the case where the connector housing 11 needs to be fixed to the plurality of types of corrugated tubes C.

In addition, the cut-outs 54 are formed in the four corner portions of the concave surface 51 of the bottom wall 50 by cutting the longitudinal end portions of the arc portions 53. Due to this, assembling and disposing the two connector housings 11 side by side in a row while directing them in the identical direction so that the ribs 41 on the one connector housing 11 of the adjacent two connector housings are placed in the cut-outs 54 on the concave surface 51 of the other connector housing 11 can reduce the resulting height (the transverse dimension in FIG. 9) of the assembled connector housings 11 more than when no such cut-outs 54 are provided.

<Third Embodiment>

Figure 23:
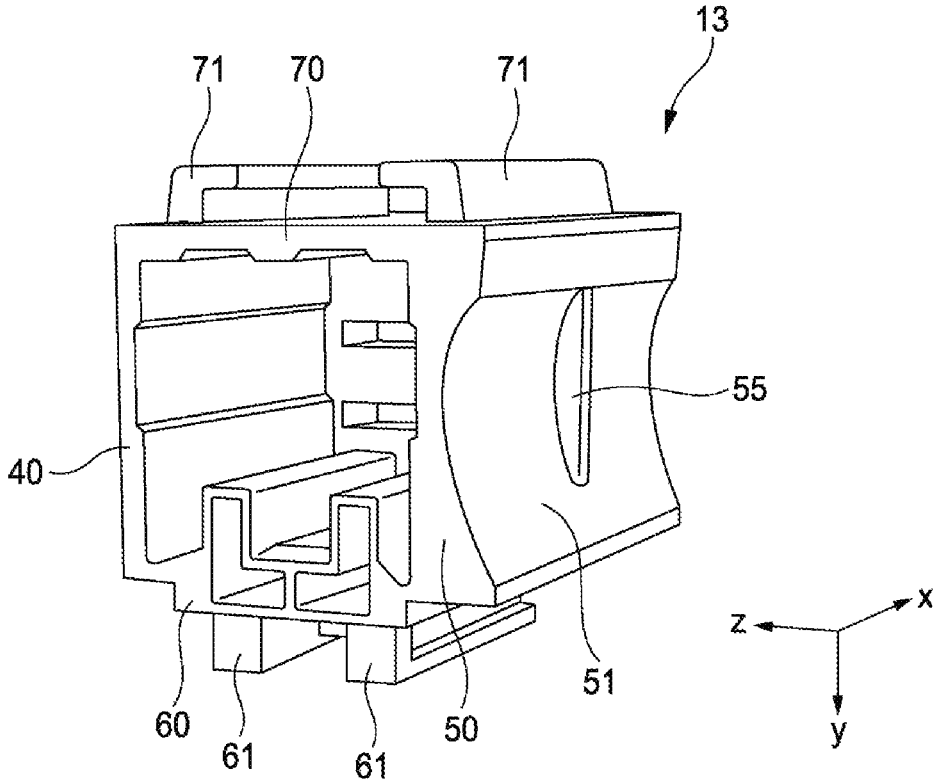
FIG. 23 is a perspective view of a connector housing according to a third embodiment.
Figure 24:
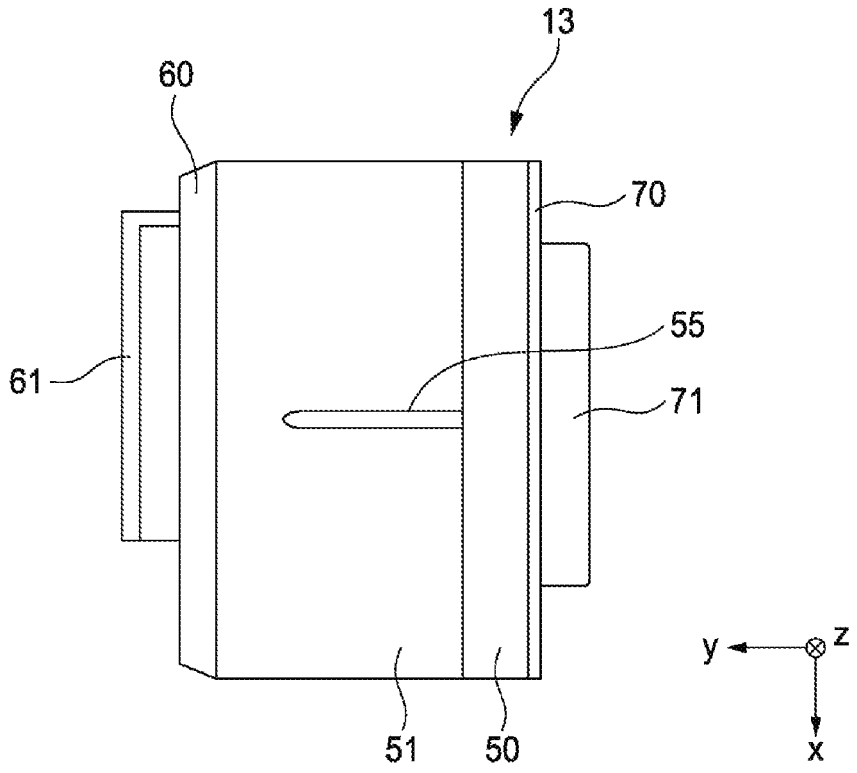
FIG. 24 is a bottom view of the connector housing according to the third embodiment.
Figure 25:
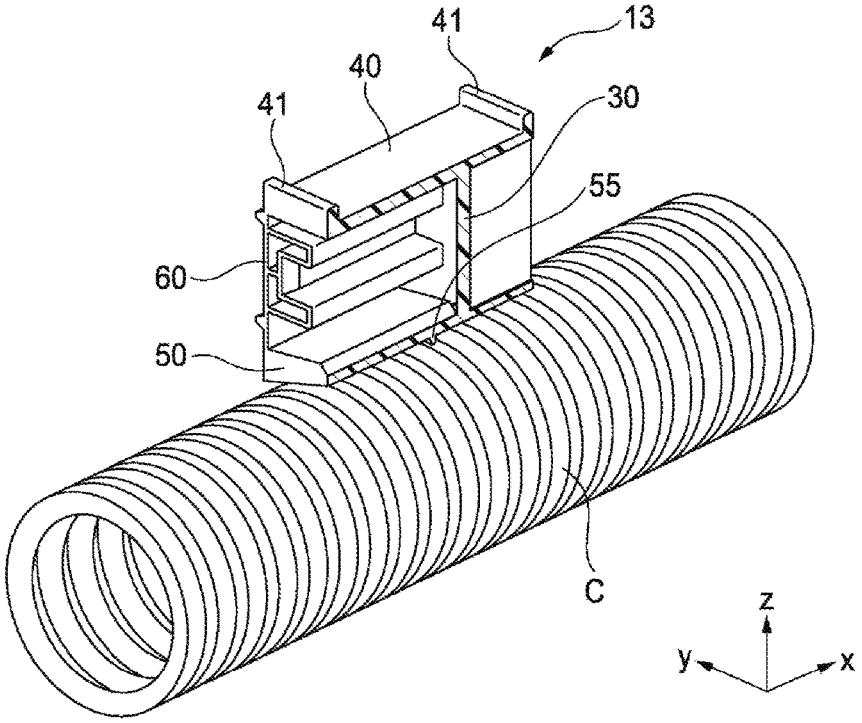
FIG. 25 is a perspective view showing a state in which a concave surface of the connector housing shown in FIG. 23 is pressed against a corrugated tube with the connector housing shown in section taken along a vertical plane that passes through an engaging projection.
Figure 26:
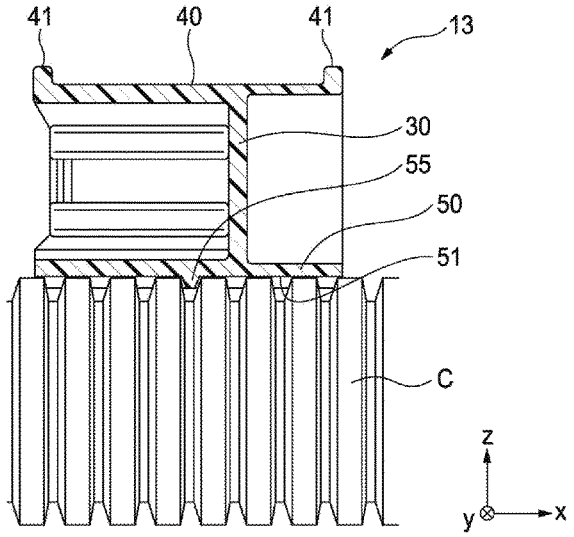
FIG. 26 is a side view showing the state in which the concave surface of the connector housing shown in FIG. 23 is pressed against the corrugated tube with the connector housing shown in section taken along the vertical plane that passes through the engaging projection.

Referring to FIGS. 23 to 26, a connector housing 13 according to a third embodiment will be described. The connector housing 13 differs from the connector housing 10 of the first embodiment or the connector housing 11 of the second embodiment in that an engaging projection 55 is provided on a concave surface 51 of a bottom wall 50. Hereinafter, the different feature will be described in detail. FIG. 23 is a perspective view of the connector housing according to the third embodiment. FIG. 24 is a bottom view of the connector housing according to the third embodiment. FIG. 25 is a perspective view showing a state in which the concave surface of the connector housing shown in FIG. 23 is pressed against a corrugated tube with the connector housing shown in section taken along a vertical plane that passes through the engaging projection. FIG. 26 is a side view showing the state in which the concave surface of the connector housing shown in FIG. 23 is pressed against the corrugated tube with the connector housing shown in section taken along the vertical plane that passes through the engaging projection.

The engaging projection 55 is a projection that projects from the concave surface 51 of the bottom wall 50 as shown in FIGS. 23 and 24. In the connector housing 13 according to the third embodiment, the engaging projection 55 is provided at a substantially central portion on the concave surface 51 in a front-and-rear direction (an x-axis direction). The engaging projection 55 constitutes an elongated projection extending along a left-and-right direction (a y-axis direction). In other words, the engaging projection 55 constitutes a rib provided along a circumferential direction of the concave surface 51 that curves inwards into an arc shape. The engaging projection 55 is shaped so as to be brought into engagement with a groove of a corrugated tube C having a corrugated configuration as shown in FIGS. 25 and 26. Due to this, a projecting height of the engaging projection 55 from the concave surface 51 is equal to a distance between a ridge and a groove on an external surface of the corrugated tube C.

Figure 27:
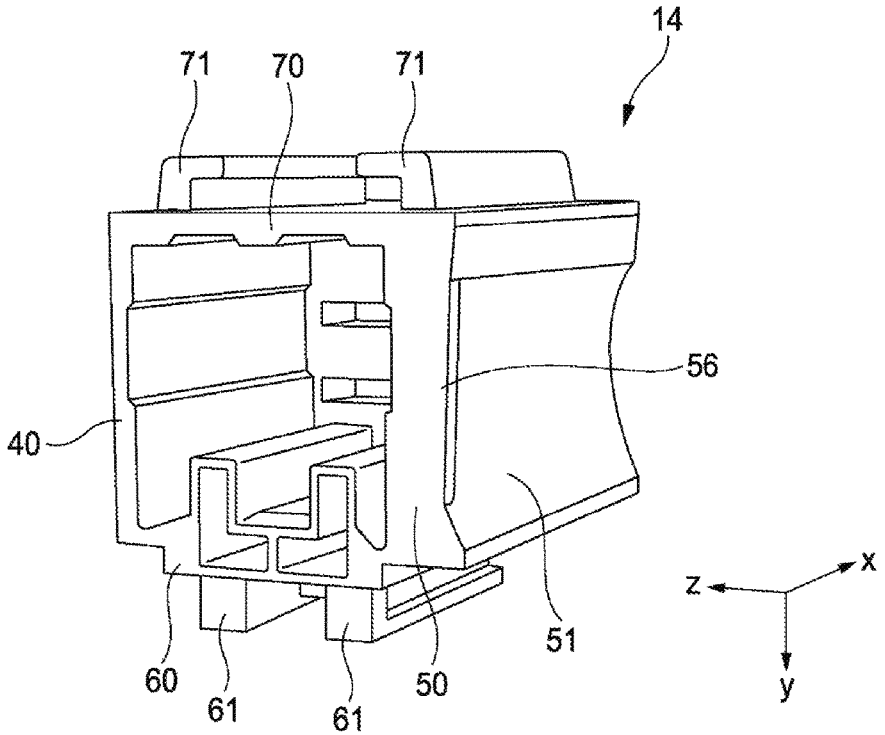
FIG. 27 is a perspective view of a connector housing according to a modified example of the third embodiment.
Figure 28:
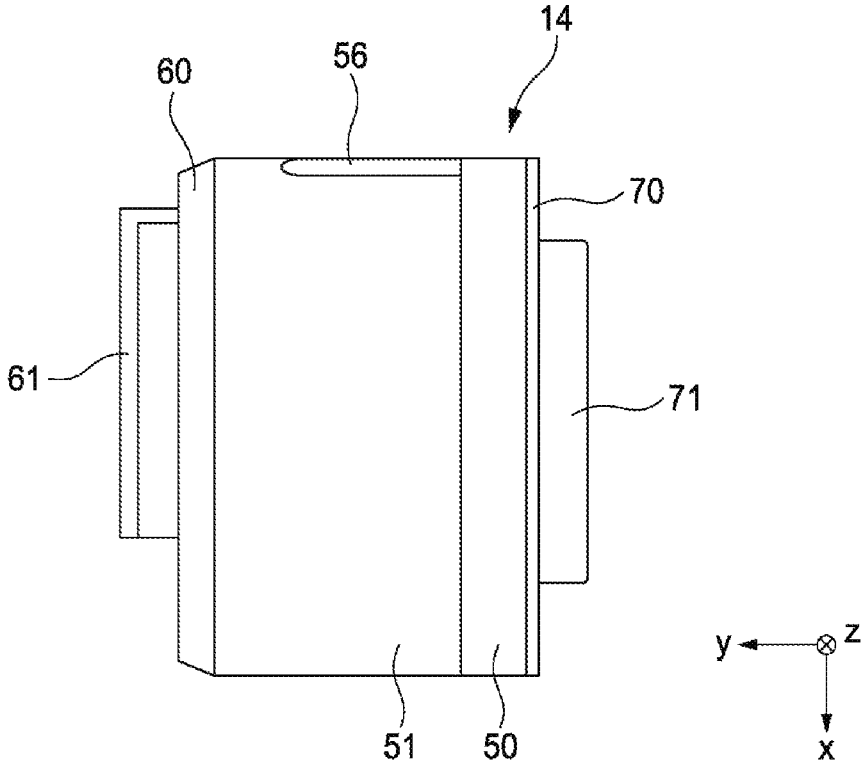
FIG. 28 is a bottom view of the connector housing according to the modified example of the third embodiment.
Figure 29:
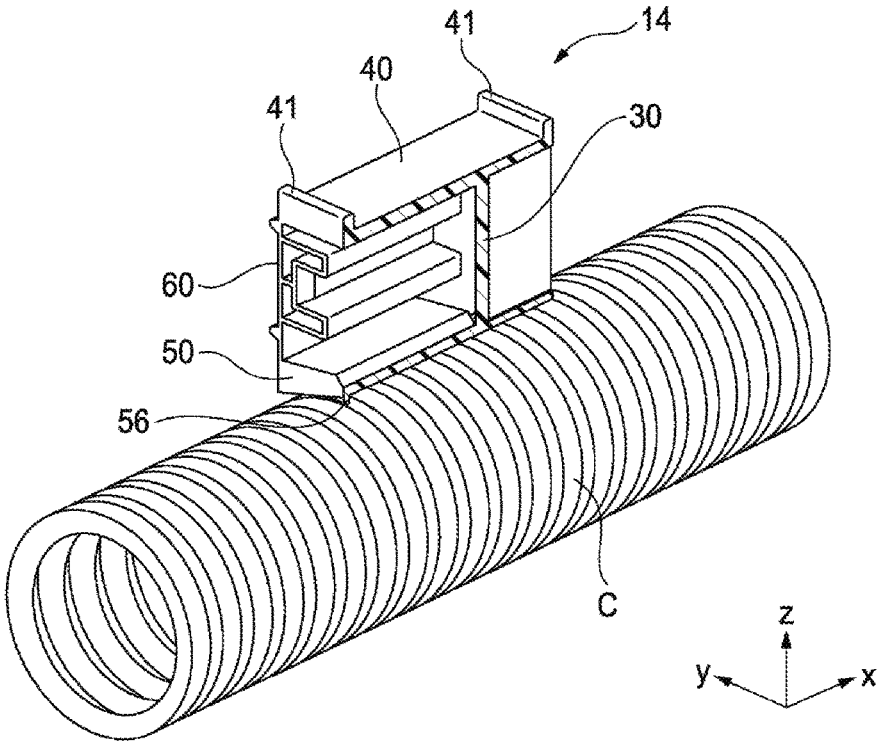
FIG. 29 is a perspective view showing a state in which a concave surface of the connector housing shown in FIG. 27 is pressed against the corrugated tube with the connector housing shown in section taken along a vertical plane that passes through an engaging projection.
Figure 30:
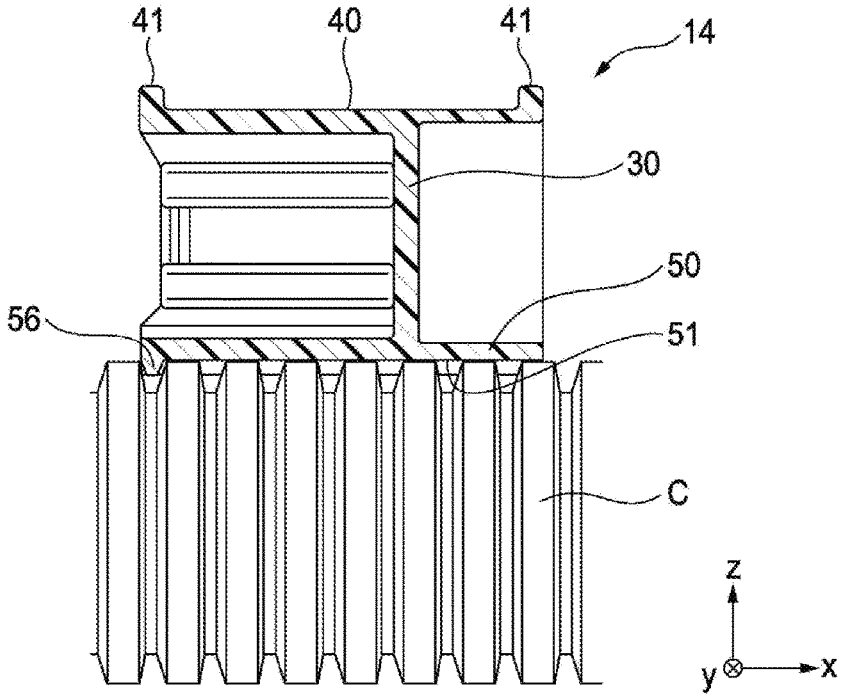
FIG. 30 is a side view showing the state in which the concave surface of the connector housing shown in FIG. 27 is pressed against the corrugated tube with the connector housing shown in section taken along the vertical plane that passes through the engaging projection.

Next, referring to FIGS. 27 to 30, a connector housing 14 according to a modified example of the third embodiment will be described. FIG. 27 is a perspective view of the connector housing according to the modified example of the third embodiment. FIG. 28 is a bottom view of the connector housing according to the modified example of the third embodiment. FIG. 29 is a perspective view showing a state in which a concave surface of the connector housing shown in FIG. 27 is pressed against the corrugated tube with the connector housing shown in section taken along a vertical plane that passes through an engaging projection. FIG. 30 is a side view showing the state in which the concave surface of the connector housing shown in FIG. 27 is pressed against the corrugated tube with the connector housing shown in section taken along the vertical plane that passes through the engaging projection.

In the connector housing 13, the engaging projection 55 is provided on the concave surface 51 at the substantially central portion in the front-and-rear direction (the x-axis direction), whereas in the connector housing 14, the engaging projection 56 is provided along a front end face of the concave surface 51, as shown in FIGS. 27 to 30. In the connector housings 13, 14, the engaging projections 55, 56 are provided at the different portions.

As can be seen from the connector housings 13, 14, the following function and advantage that are specific to the third embodiment can be obtained even though the engaging projections 55, 56 are provided anywhere on the concave surface 51 in the front-and-rear direction (the x-axis direction).

In the connector housings 13, 14 according to the third embodiment, the engaging projections 55, 56 are formed on the concave surface 51. This brings the engaging projections 55, 56 into engagement with a groove of the corrugated tube C having the corrugated configuration when the connector housings 13, 14 are disposed on the outer circumferential surface of the corrugated tube C. This allows the connector housings 13, 14 to be caught on the corrugated tube C. This can prevent the connector housings 13, 14 from sliding on the external surface of the corrugated tube C when a tape T is wound around an outer circumferential surface of the corrugated tube C and outer circumferential surfaces of side walls 20 of the connector housings 13, 14 so as to cover them altogether. This allows the working person to wind stably the tape around the connector housings 13, 14 that are fixed to the external surface of the corrugated tube C.

The engaging projections 55, 56 are configured as the ribs provided along the circumferential direction of the concave surface 51 that curves inwards into the arc shape. This structure ensures a sufficient engaging margin for the engaging projections 55, 56, allowing them to engage sufficiently with the groove of the corrugated tube C that is formed thereon along a circumferential direction thereof. This can prevent more efficiently the connector housings 13, 14 from sliding on the external surface of the corrugated tube C.

In the third embodiment, the engaging projection 55 is described as being formed into the elongated projection. The engaging projection does not have to be formed into the elongated projection. For example, even though the engaging projections 55, 56 are formed into a conical or cylindrical projection that projects from one location, the engaging projections 55, 56 can be brought into engagement with the groove of the corrugated tube C having the corrugated configuration. In this way, the configuration of the engaging projection can be modified as required according to a degree of an engaging margin that is desired to be ensured relative to the groove of the corrugated tube C that is formed thereon along the circumferential direction thereof.

The projecting height of the engaging projection from the concave surface 51 is described as being equal to the distance between the ridge and the groove on the external surface of the corrugated tube C. The projecting height of the engaging projection may be shorter or longer than the distance between the ridge and the groove on the external surface of the corrugated tube C. The engaging margin that is desired to be ensured relative to the groove formed on the corrugated tube C along the circumferential direction thereof becomes shallow by reducing the projecting height of the engaging projection, whereas the engaging margin becomes deep by increasing the projecting height of the engaging projection. By increasing or reducing the projecting height of the engaging projection in the way described above, the engaging force required on the engaging projection can be controlled. A distal end of the engaging projection is brought into contact with the corrugated tube C by setting the projecting height of the engaging projection to be longer than the distance between the ridge and the groove on the external surface of the corrugated tube C. Even though the engaging projection is brought into contact with the corrugated tube C, such a contact will be no problem in winding the tape stably, provided that the external surface of the corrugated tube C is permitted to be deformed to some extent. Moreover, the fact that the engaging projection bites into the external surface of the corrugated tube C can serve to prevent the connector housings 13, 14 from sliding on the external surface of the corrugated tube C. This allows the working person to wind stably the tape around the connector housings 13, 14 that are fixed to the external surface of the corrugated tube C more rigidly.

The structure described in the third embodiment can be applied to the connector housing of the first embodiment or the second embodiment. In particular, the engaging projection described above can be applied to the concave surface 51 of the second embodiment that includes the arc portion 52 and the arc portions 53 that have the different radii of curvature. As this occurs, engaging projections are provided individually on the arc portion 52 and the arc portions 53.

<Fourth Embodiment>

Figure 31A:
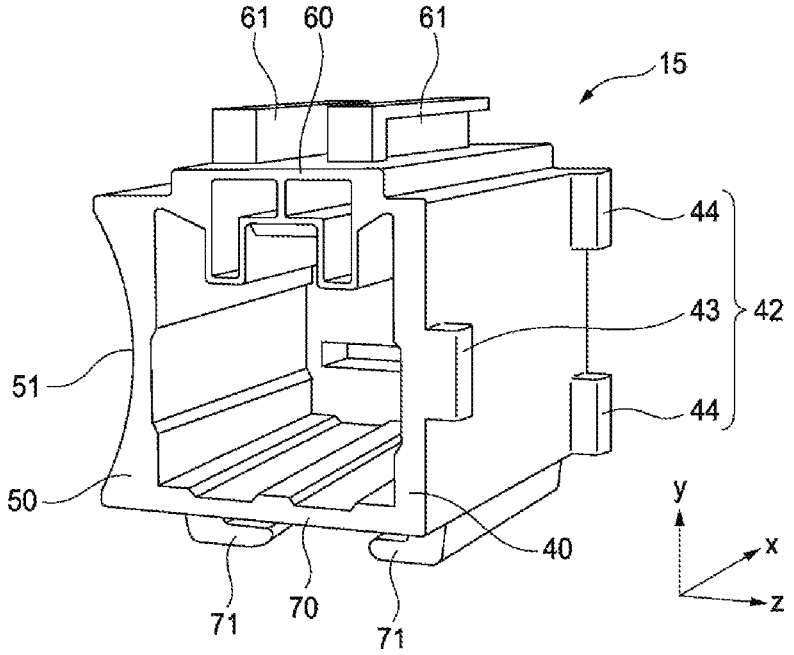
FIGS. 31A and 31B are perspective views showing a connector housing according to a fourth embodiment.
Figure 31B:
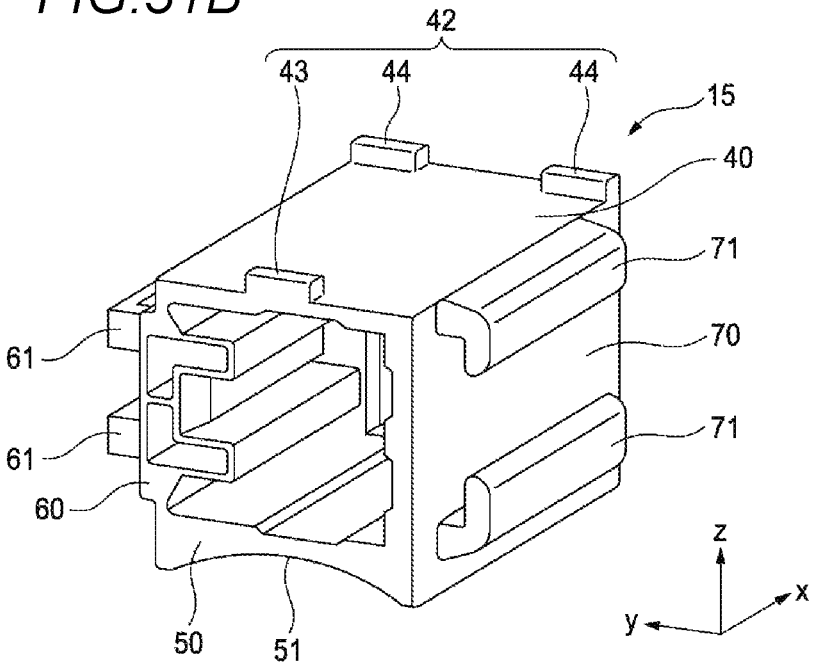

Next, referring to FIG. 31, a connector housing 15 according to a fourth embodiment will be described. The connector housing 15 differs in the shape of ribs 42 formed on an outer circumferential surface of a top wall 40 from the ribs 41 of the connector housing 10 of the first embodiment, the connector housing 11 of the second embodiment or the connector housings 13, 14 of the third embodiment. Hereinafter, the different feature will be described in detail. FIGS. 31A and 31B are perspective views showing the connector housing 15 according to the fourth embodiment.

In the connector housings according to the first to third embodiments, the pair of parallel ribs 41 are formed at the longitudinal end portions of the outer circumferential surface (the external surface) of the top wall 40 so as to face each other. The connector housing 15 according to the fourth embodiment is similar to the housings 10, 11, 13 and 14 in that the ribs 42 are formed at longitudinal end portions of the outer circumferential surface of the top wall 40, but the ribs 42 are not formed so as to face each other. Namely, a front rib 43 situated at a front end portion of the top wall 40 is provided at a transverse center of the front end portion, and a portion of a rear end portion of the top wall 40 that is situated to the rear of the front rib 43 is cut out. On the other hand, rear ribs 44 situated at the rear end portion of the top wall 40 are provided at transverse ends of the rear end portion, and portions of the front end portion of the top wall 40 that are situated to the front of the rear ribs 44 are cut out. In the ribs 42, the front rib 43 and the rear ribs 44 are disposed at the longitudinal end portions of the top wall 40 so as not to face each other in a front-and-rear direction.

Figure 32A:
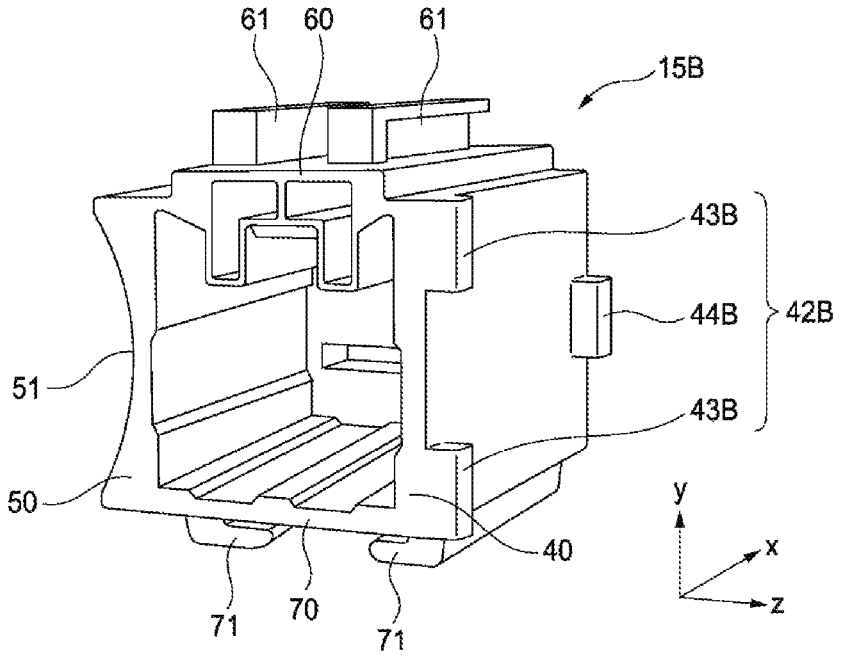
FIGS. 32A and 32B are perspective views showing a connector housing according to a modified example of the fourth embodiment.
Figure 32B:
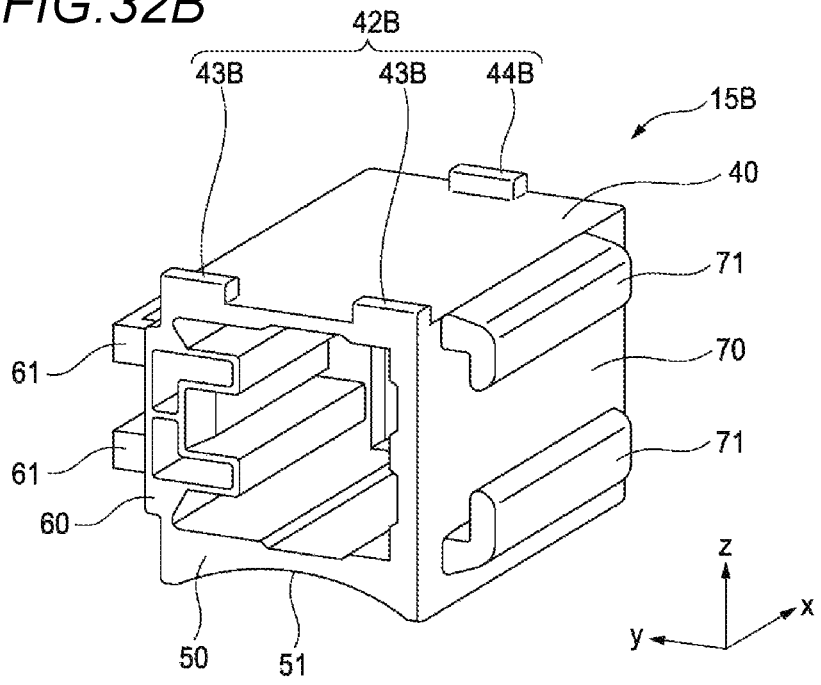
Figure 33A:
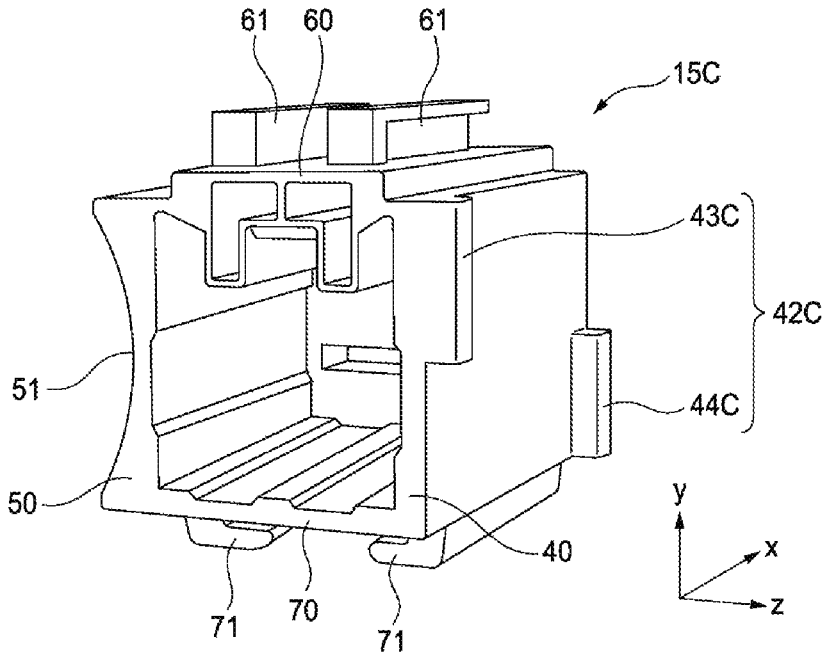
FIGS. 33A and 33B are perspective views showing a connector housing according to another modified example of the fourth embodiment.
Figure 33B:
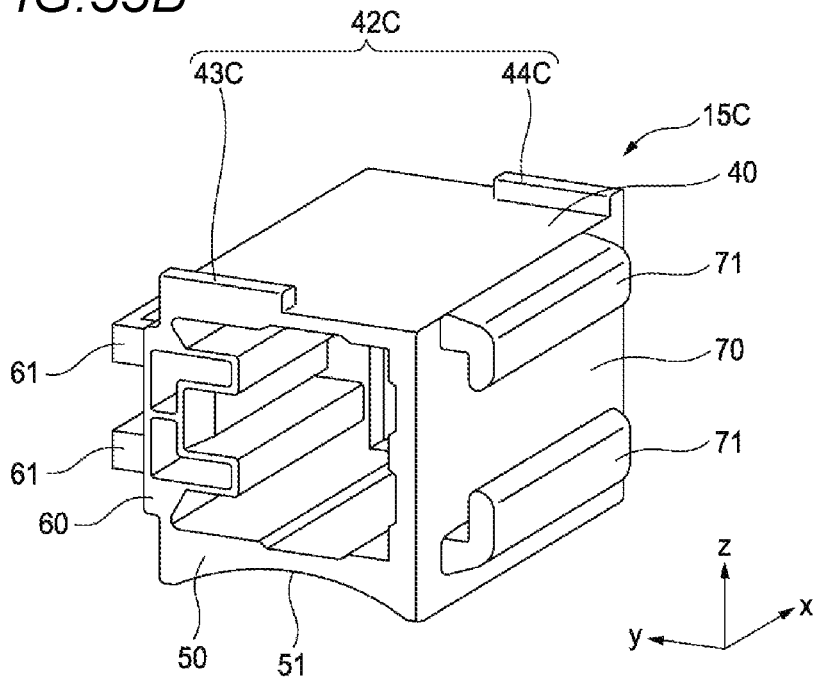
Figure 34A:
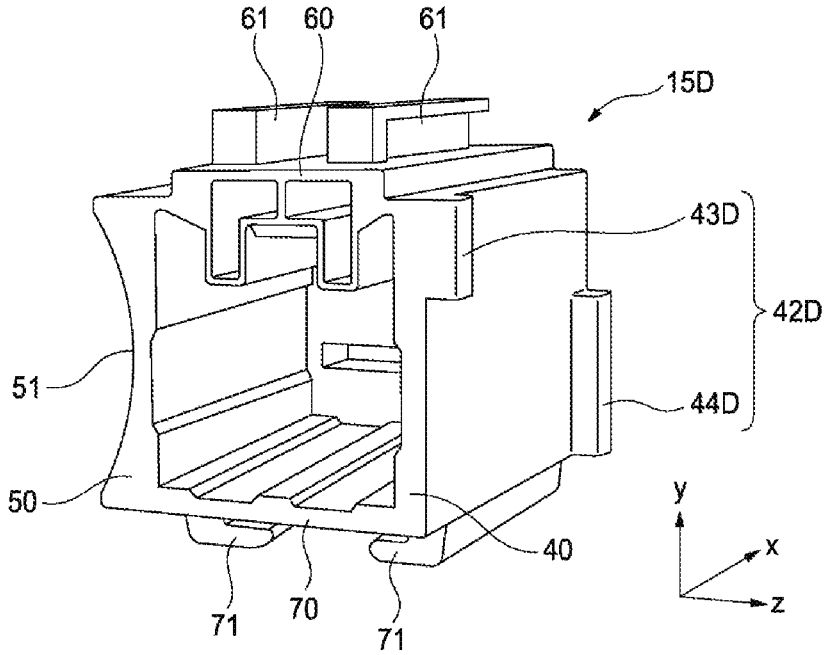
FIGS. 34A and 34B are perspective views showing a connector housing according to a further modified example of the fourth embodiment.
Figure 34B:
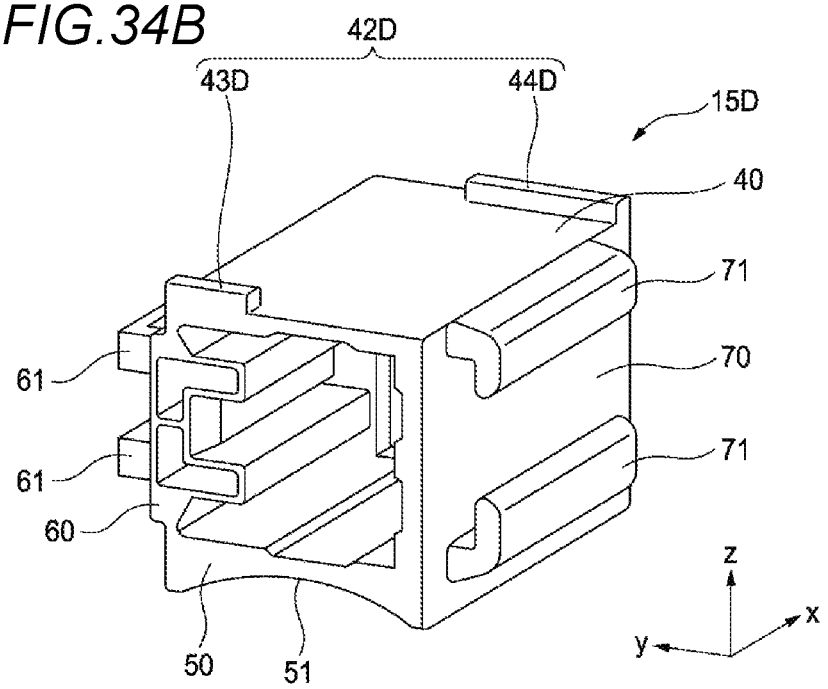
Figure 35A:
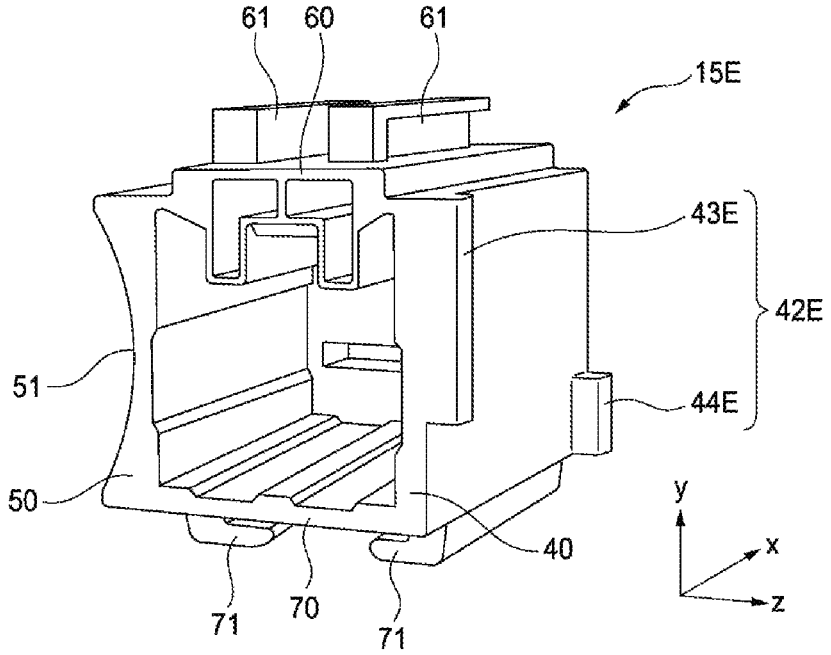
FIGS. 35A and 35B are perspective views showing a connector housing according to a modified example of the fourth embodiment.
Figure 35B:
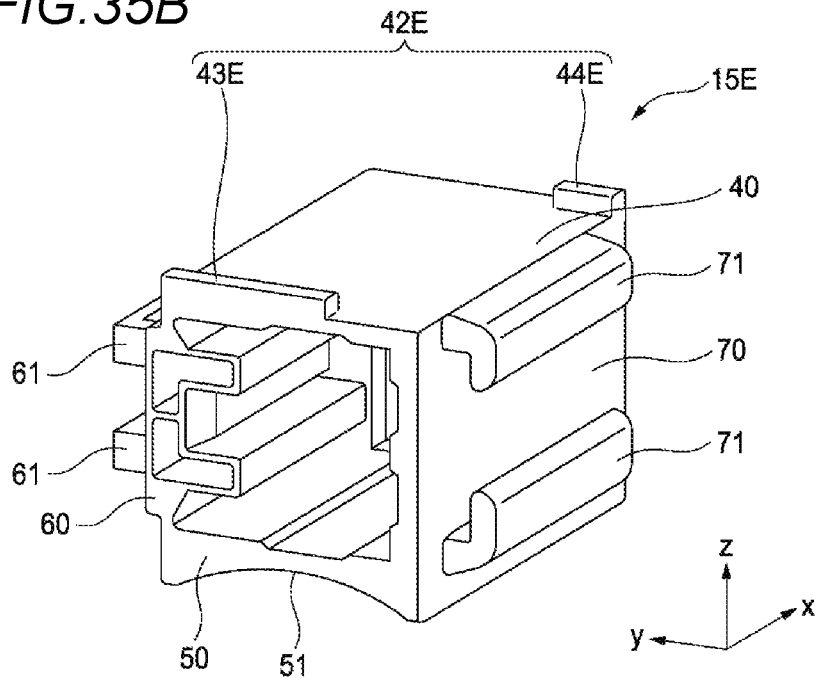
Figure 36A:
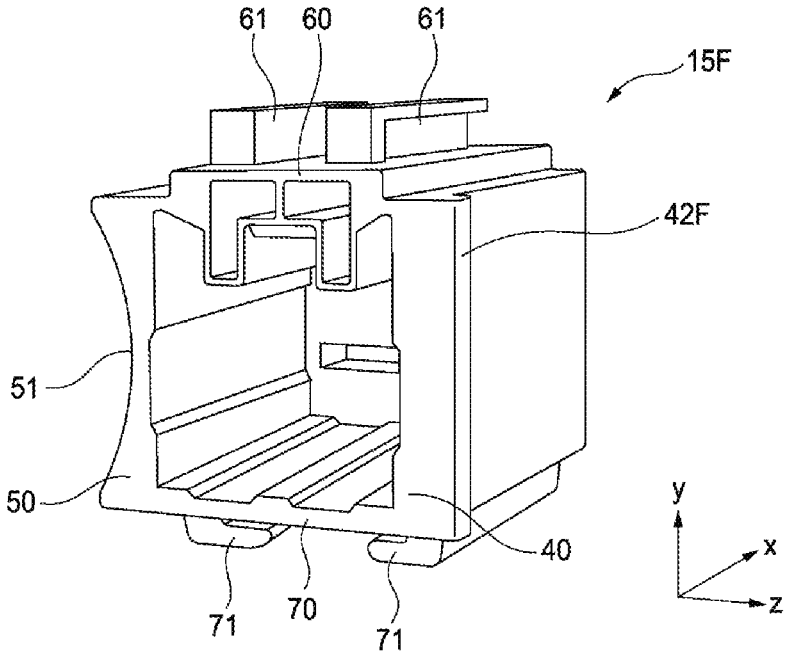
FIGS. 36A and 36B are perspective views showing a connector housing according to another modified example of the fourth embodiment.
Figure 36B:
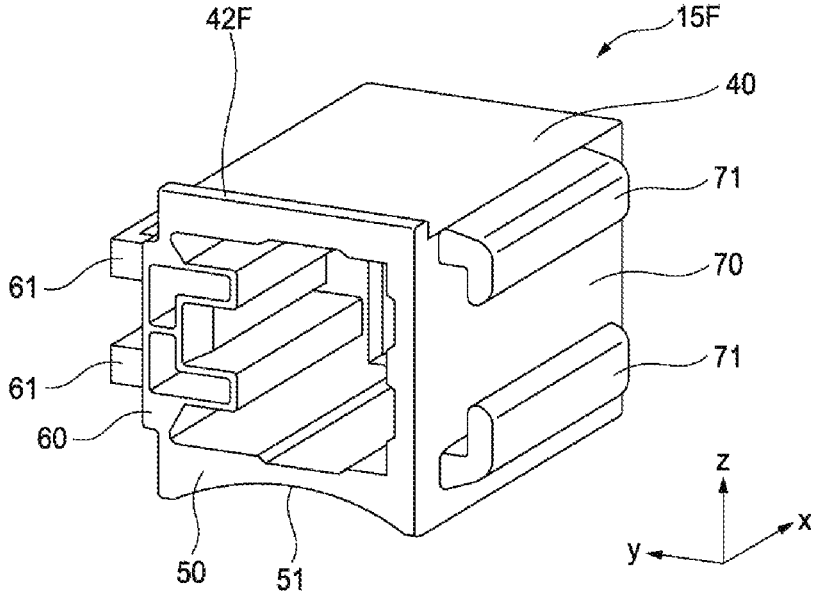
Figure 37A:
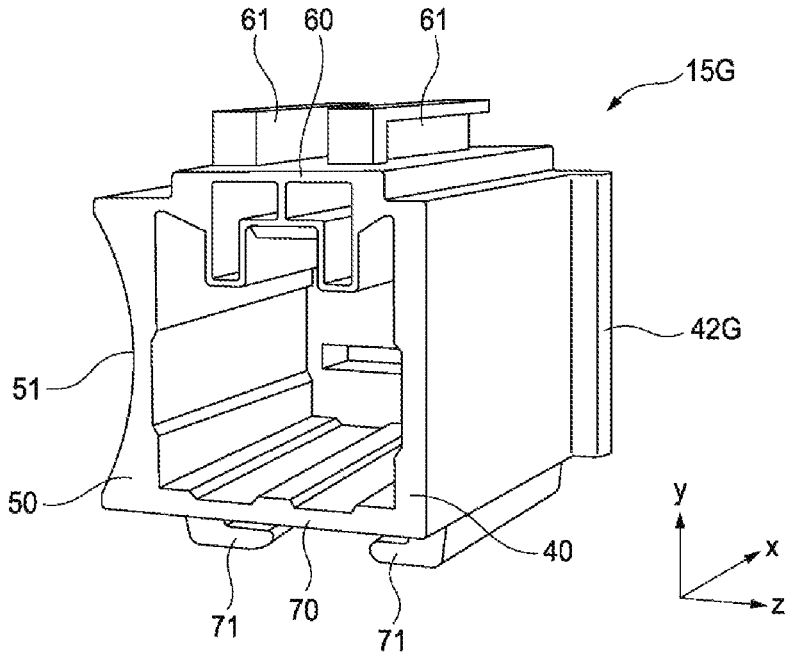
FIGS. 37A and 37B are perspective views showing a connector housing according to a further modified example of the fourth embodiment.
Figure 37B:
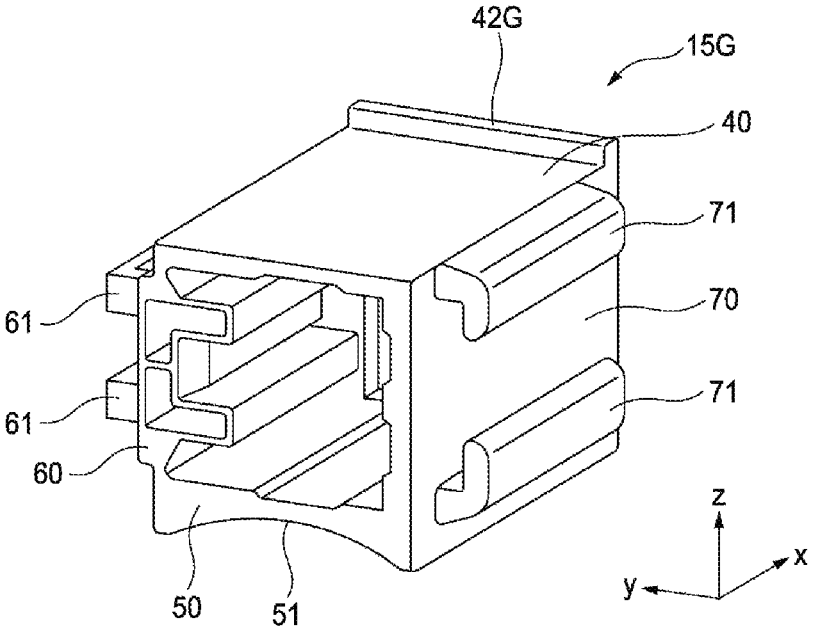

Next, referring to FIGS. 32 to 37, connector housings 15B, 15C, 15D, 15E, 15F, 15G according to modified examples of the fourth embodiment will be described. FIG. 32 shows perspective views of a connector housing according to a modified example of the fourth embodiment. FIG. 33 shows perspective views of a connector housing according to another modified example of the fourth embodiment. FIG. 34 shows perspective views of a connector housing according to a further modified example of the fourth embodiment. FIG. 35 shows perspective views of a connector housing according to a modified example of the fourth embodiment. FIG. 36 shows perspective views of a connector housing according to another modified example of the fourth embodiment. FIG. 37 shows perspective views of a connector housing according to a further modified example of the fourth embodiment.

In a connector housing 15B according a modified example of the fourth embodiment, as shown in FIG. 32, ribs 42B are formed at longitudinal end portions on an outer circumferential surface (an external surface) of a top wall 40. However, the ribs 42B are not formed so as to face each other in the front-and-rear direction. Namely, front ribs 43B situated at a front end portion of the top wall 40 are provided individually at transverse end portions of the front end portion, and portions of a rear end portion of the top wall 40 that are situated to the rear of the front ribs 43B are cut out. On the other hand, a rear rib 44B situated at the rear end portion of the top wall 40 is provided at a transverse center of the rear end portion, and a portion of the front end portion of the top wall 40 that is situated to the front of the rear rib 44B is cut out. In the ribs 42B, the front ribs 43B and the rear rib 44B are disposed at the longitudinal end portions of the top wall 40 in a zigzag fashion so as not to face each other in the front-and-rear direction.

In a connector housing 15C according to another modified example of the fourth embodiment, as shown in FIG. 33, ribs 42C are formed at longitudinal end portions on an outer circumferential surface (an external surface) of a top wall 40. However, the ribs 42C are not formed so as to face each other in the front-and-rear direction. Namely, a front rib 43C situated at a front end portion of the top wall 40 is provided at a left-half portion of the front end portion, and a portion of a rear end portion of the top wall 40 that is situated to the rear of the front rib 43C is cut out. On the other hand, a rear rib 44C situated at the rear end portion of the top wall 40 is provided at a right-half portion of the rear end portion, and a portion of the front end portion of the top wall 40 situated to the front of the rear rib 44C is cut out. In the ribs 42C, the front rib 43C and the rear rib 44C are disposed at the longitudinal end portions of the top wall 40 in a zigzag fashion so as not to face each other in the front-and-rear direction.

In a connector housing 15D according a further modified example of the fourth embodiment, as shown in FIG. 34, ribs 42D are formed at longitudinal end portions on an outer circumferential surface (an external surface) of a top wall 40. However, the ribs 42D are not formed so as to face each other in the front-and-rear direction. Namely, a front rib 43D situated at a front end portion of the top wall 40 is provided at a left portion of the front end portion, and a portion of a rear end portion of the top wall 40 that is situated to the rear of the front rib 43D is cut out. On the other hand, a rear rib 44D situated at the rear end portion of the top wall 40 is provided at a right portion of the rear end portion, and a portion of the front end portion of the top wall 40 situated to the front of the rear rib 44D is cut out. A transverse width of the front rib 43D is narrower than a transverse width of the rear rib 44D. In the ribs 42D, the front rib 43D and the rear rib 44D are disposed at the longitudinal end portions of the top wall 40 in a zigzag fashion so as not to face each other in the front-and-rear direction.

In a connector housing 15E according to a modified example of the fourth embodiment, as shown in FIG. 35, ribs 42E are formed at longitudinal end portions on an outer circumferential surface (an external surface) of a top wall 40. However, the ribs 42E are not formed so as to face each other in the front-and-rear direction. Namely, a front rib 43E situated at a front end portion of the top wall 40 is provided at a left portion of the front end portion, and a portion of a rear end portion of the top wall 40 that is situated to the rear of the front rib 43E is cut out. On the other hand, a rear rib 44E situated at the rear end portion of the top wall 40 is provided at a right portion of the rear end portion, and a portion of the front end portion of the top wall 40 situated to the front of the rear rib 44E is cut out. A transverse width of the front rib 43E is wider than a transverse width of the rear rib 44E. In the ribs 42E, the front rib 43E and the rear rib 44E are disposed at the longitudinal end portions of the top wall 40 in a zigzag fashion so as not to face each other in the front-and-rear direction.

In a connector housing 15F according to another modified example of the fourth embodiment, as shown in FIG. 36, a rib 42F is provided only at a front end portion of an outer circumferential surface (an external surface) of a top wall 40 so as to extend an overall transverse length of the front end portion, and no rib is formed at a rear end portion of the outer circumferential surface (the external surface) of the top wall 40.

In a connector housing 15G according to a further modified example of the fourth embodiment, as shown in FIG. 37, a rib 42G is provided only at a rear end portion of an outer circumferential surface (an external surface) of a top wall 40 so as to extend an overall transverse length of the rear end portion, and no rib is formed at a front end portion of the outer circumferential surface (the external surface) of the top wall 40.

In fabricating the connector housings of embodiments through resin molding using molds, two molds are disposed to be aligned in the front-and-rear direction of a connector housing to be fabricated to form an interior space S of the connector housing. As this occurs, forming the ribs 42, 42B, 42C, 42D, 42E, 42F, 42G at the longitudinal end portions of the top wall 40 so as not to face each other (refer to FIGS. 31 to 35) in the front-and-rear direction or only at either of the longitudinal end portions of the top wall 40 (refer to FIGS. 36 and 37) simplifies the removal of the molds. Namely, in the case where ribs are formed at the longitudinal end portions of the top wall 40 in positions that face each other in the front-and-rear direction, a slide core that slides in the left-and-right direction or the up-and-down direction needs to be used to form the ribs. On the other hand, with the connector housing 15 according to the fourth embodiment, no slide core is needed to remove the molds, and this can simplify the molding process.

Even though the ribs 42, 42B, 42C, 42D, 42E, 42E 42G are formed in the ways described above, in winding a tape T around the connector housing 15, the tape T can easily be wound around the connector housing 15 by positioning the tape T between the pair of ribs 42, 42B, 42C, 42D, 42E or by winding the tape T based on the rib 42E 42G formed only at either of the longitudinal end portions of the top wall 40. Additionally, forming the ribs as described above prevents the tape T from being wound around out of place or deviating in relation to the transverse direction (in relation to the front-and-rear direction of the connector housing 15).

Figure 38A:
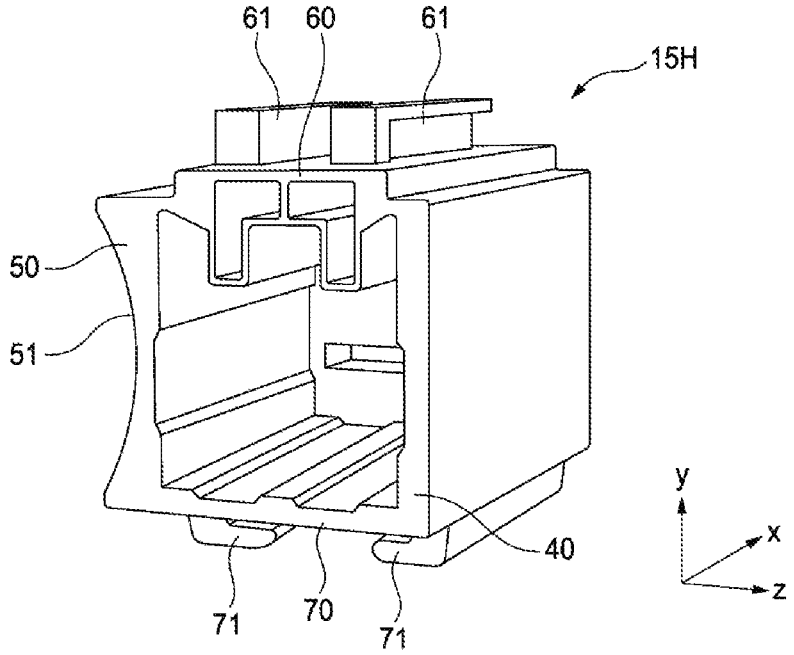
FIGS. 38A and 38B are perspective views showing a connector housing according to a reference example of the fourth embodiment.
Figure 38B:
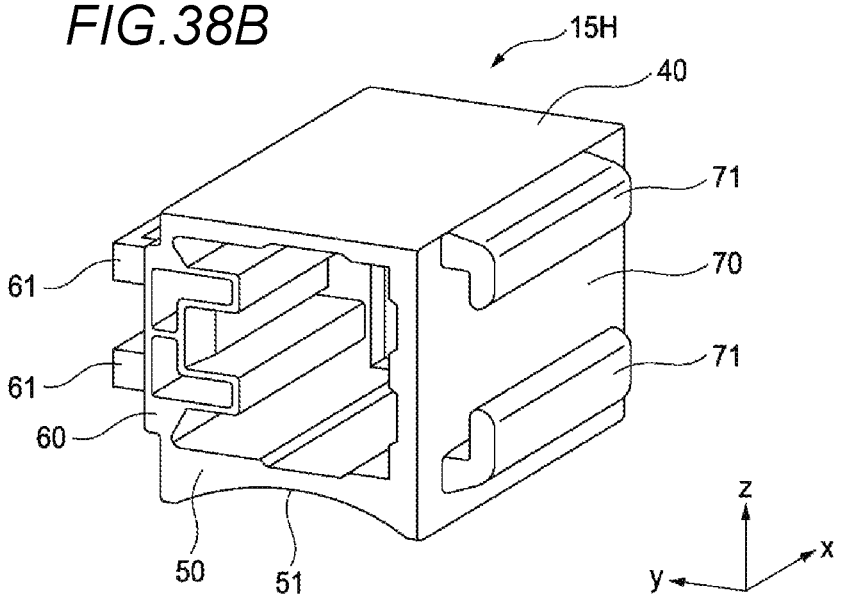

Removing the molds without using a slide core can result in a thought that no ribs are provided at the longitudinal end portions of the top wall 40. FIG. 38 shows perspective views of a connector housing according to a reference example of the fourth embodiment. In a connector housing 15H according the reference example of the fourth embodiment, as shown in FIG. 38, a rib is formed neither at a front end portion nor at a rear end portion on an outer circumferential surface (an external surface) of a top wall 40. The removal of molds can also be simplified by the configuration described above.

The structures described in the fourth embodiment may be applied to the connector housing of the first embodiment, the second embodiment or the third embodiment.

<Other Embodiments>

The invention is not limited to the embodiments that have been described heretofore, and hence, various modified examples may be adopted within the spirit and scope of the invention. For example, the invention is not limited to the embodiments described above and hence may be modified or improved as required. Besides, the materials, shapes, dimensions, numbers, and locations of the constituent elements of the embodiments are not limited thereto and hence are arbitrary, provided that the invention may be achieved by them.

In the second embodiment, the concave surface 51 of the bottom wall 50 includes the two types of arc portions having the different radii of curvature. However, the concave surface 51 may include three or more arc portions having different radii of curvature.

In the second embodiment, the cut-outs 54 are formed on the concave surface 51 of the bottom wall 50 by cutting out the portions of the arc portions. However, no such cut-outs may be formed.

Embodiments will be enumerated one by one under [1] to [6] below.

[1] A connector housing (10, 11) having a cylindrical side wall (20), including:

a concave surface (51) curving inwards into an arc shape and extending in one direction, the concave surface (51) being formed on one side (the bottom wall 50) of an outer circumferential surface of the side wall (20) to be pressed against a cylindrical member (the corrugated tube C) with the one direction aligned with a direction in which the cylindrical member (the corrugated tube C) extends.

[2] The connector housing (11) according to [1] above, in which the concave surface (51) includes a plurality of types of arc portions (52, 53) having different radii of curvature.

[3] The connector housing (11) according to [2] above, in which the concave surface (51) includes a first arc portion (52) having a relatively small radius of curvature and second arc portions (53) having a relatively great radius of curvature and provided on outer sides of the first arc portion.

[4] The connector housing (11) according to any one of [1] to [3] above, in which the concave surface (51) includes an engaging projection (55, 56) formed thereon to be brought into engagement with a groove of a corrugated tube C having a corrugated configuration.

[5] The connector housing according to [4] above, in which the engaging projection (55, 56) is a rib provided along a circumferential direction of the concave surface (51).

[6] The connector housing (10, 11) according to any one of [1] to [5], in which two ribs (41) projecting outwards and intersecting the one direction are formed on an other (the top wall 40) side of the outer circumferential surface of the side wall (20) that differs from the one side (the bottom wall 50).

[7] The connector housing (11) according to [6], in which the ribs (41) are formed on the other side (the top wall 40) of the outer circumferential surface of the side wall (20) that constitutes an opposite side to the one side (the bottom wall 50), and in which cut-outs (54) are formed on the concave surface (51), the cut-outs (54) being configured to allow the ribs (41) to enter the cut-outs (54) when two connector housings like the connector housing (11) are aligned in an identical direction so that the concave surface (51) formed on the one side (the bottom wall 50) of one of the two connector housings faces the ribs (41) formed on the other side (the top wall 40) of the other connector housing.

[8] A connector unit (the connected connector housing 12) including:

a first connector housing that is the connector housing according to [7] above;

a second connector housing that is the connector housing according to [7] above; and a connecting member (the connecting plate 80) configured to fix the first connector housing and the second connector housing together with the ribs (41) formed on the other side (the top wall 40) of the second connector housing placed in the cut-outs (54) formed on the one side (the bottom wall 50) of the first connector housing.

In the connector housing according to [1] above, the concave surface curving inwards into the arc shape and extending in the one direction is formed on the one side of the outer circumferential surface of the side wall. Even in the case where the connector housing is disposed on an outer circumferential surface of the cylindrical member, the connector housing can be kept in an appropriate posture relative to the cylindrical member by pressing the connector housing against the cylindrical member with the one direction in which the concave surface extends aligned with the direction in which the cylindrical member extends. Winding a tape around the outer circumferential surface of the cylindrical member and the outer circumferential surface of the side wall of the connector housing so as to cover them altogether in the state described above allows the connector housing to be fixed easily to the outer circumferential surface of the cylindrical member while keeping the connector housing in an appropriate posture relative to the cylindrical member.

In the connector housing according to [2] and [3] above, the concave surface includes the plurality of types of arc portions having the different radii of curvature. Thus, even in the case where the connector housing needs to be fixed to each of a plurality of types of cylindrical members having different outside diameters, the connector housing can be kept in the appropriate posture relative to the plurality of types of cylindrical members.

In the connector housing according to [4] above, the connector housing can be caught on the corrugated tube. This can prevent the connector housing from sliding on an external surface of the corrugated tube when a tape is wound around an outer circumferential surface of the corrugated tube and the outer circumferential surface of the connector housing so as to cover them altogether. This allows the working person to wind stably the tape around the connector housing fixed to the outer surface of the corrugated tube.

In the connector housing according to [5] above, a sufficient engaging margin is ensured for the engaging projection, allowing the engaging projection to engage sufficiently with the groove of the corrugated tube that is formed thereon along a circumferential direction thereof. This prevents the connector housing from sliding on the external surface of the corrugated tube.

In the connector housing according to [6] above, the ribs are formed on the other side of the outer circumferential surface of the side wall that differs from the one side so as not only to project outwards but also to extend in the direction intersecting the one direction. This allows the tape to be wound around easily based on the ribs when the tape is wound around the connector housing and prevents the tape from being wound around out of place by winding the tape around the connector housing so that transverse end faces of the tape lie near the ribs (or the transverse end faces of the tape lie in contact with the ribs).

In the connector housing according to [7] above, the cut-outs are formed on the concave surface so that when the two connector housings are aligned in the identical direction, the ribs formed on the mating connector housing are placed in the cut-outs. Assembling and disposing the plurality of connector housings side by side in a row while directing them in the identical direction so that the ribs on one of the adjacent connector housings are placed in the cut-outs on the concave surface of the other connector housing can reduce the resulting height of the assembled connector housings more than when no such cut-outs are provided. In one application, the connector housing is fixed along to the cylindrical member for use, and in the other application, the plurality of connector housings are aligned to be fixed to a vehicle body or an electrical junction box of a motor vehicle for use. This can reduce a space to be occupied by the whole of the plurality of connector housings when the plurality of connector housings are assembled to the vehicle body or the electrical junction box while being assembled and disposed side by side in a row while being oriented in the identical direction.

In the connector housings according to [8] above, the cut-outs are formed on the concave surface so that when the two connector housings are aligned in the identical direction, the ribs formed on the mating connector housing are placed in the cut-outs. Assembling and disposing the plurality of connector housings side by side in a row while directing them in the identical direction so that the ribs on one of the adjacent connector housings are placed in the cut-outs on the concave surface of the other connector housing can reduce the resulting height of the assembled connector housings more than when no such cut-outs are provided. In one application, the connector housing is fixed along to the cylindrical member for use, and in the other application, the plurality of connector housings are aligned to be fixed to a vehicle body or an electrical junction box of a motor vehicle for use. This can reduce a space to be occupied by the whole of the plurality of connector housings when the plurality of connector housings are assembled to the vehicle body or the electrical junction box while being assembled and disposed side by side in a row while being oriented in the identical direction.

According to embodiments, the connector housing can easily be fixed to the cylindrical member while being kept in an appropriate posture even in the case where the connector housing is disposed on the outer circumferential surface of the cylindrical member.

DESCRIPTION OF SYMBOLS

10 Connector Housing
11 Connector Housing
12 Connected connector housing
13 Connector housing
14 Connector housing
15 Connector housing
15B Connector housing
15C Connector housing
15D Connector housing
15E Connector housing
15F Connector housing
15G Connector housing
15H Connector housing
20 Side wall
30 Rear wall
31 Slit
40 Top wall
41 Rib
42 Rib
42B Rib
42C Rib
42D Rib
42E Rib
42F Rib
42G Rib
43 Front rib
43B Front rib
43C Front rib
43D Front rib
43E Front rib
44 Rear rib
44B Rear rib
44C Rear rib
44D Rear rib
44E Rear rib
50 Bottom wall

51 Concave surface
52 Arc portion
53 Arc portion
54 Cut-out
55 Engaging projection
56 Engaging projection
60 Left wall
61 Male through lock
62 Lock beak
70 Right wall
71 Female through lock
72 Projection
80 Connecting plate
81 Through lock
82 Through lock
90 Connecting jig
C Corrugated tube
S Interior space;
T Tape

What is claimed is:

1. A connector housing comprising:

a cylindrical side wall, wherein the cylindrical side wall includes a concave surface on one side of an outer circumferential surface of the cylindrical side wall in a first direction, wherein the concave surface curves inwards into an arc shape and extends in a second direction, so that the concave surface is to be pressed against a cylindrical member with the second direction aligned with a direction in which the cylindrical member extends, wherein the concave surface includes a first arc portion and second arc portions, a first one of the arc portions provided on a first outer side of the first arc portion in a third direction which is perpendicular to both the first direction and the second direction, and a second one of the second arc portions provided on a second outer side of the first arc portion in the third direction, wherein a radius of curvature of each of the second arc portions is larger than a radius of curvature of the first arc portion.

2. The connector housing according to claim 1, wherein the first arc portion extends in the second direction and the second arc portions extend in the second direction.

3. The connector housing according to claim 1, wherein the concave surface includes an engaging projection to be brought into engagement with a groove of a corrugated tube having a corrugated configuration.

4. The connector housing according to claim 3, wherein the engaging projection includes a rib provided along a circumferential direction of the concave surface.

5. The connector housing according to claim 1, further comprising:

two ribs provided on another side of the outer circumferential surface of the side wall which is different from said one side, wherein the two ribs protrude outwards from said another side of the outer circumferential surface of the side wall and extend in a direction which crosses to the second direction.

6. A connector housing comprising:

a cylindrical side wall, wherein:

the cylindrical side wall includes a concave surface on one side of an outer circumferential surface of the cylindrical side wall in a first direction, the concave surface curves inwards into an arc shape and extends in a second direction, so that the concave surface is to be pressed against a cylindrical member with the second direction aligned with a direction in which the cylindrical member extends; and two ribs provided on another side of the outer circumferential surface of the side wall which is different from said one side, wherein the two ribs protrude outwards from said another side of the outer circumferential surface of the side wall and extend in a direction which crosses to the second direction, wherein said another side of the outer circumferential surface of the side wall is opposite in the first direction to said one side of an outer circumferential surface of the cylindrical side wall, and wherein the concave surface is formed with cut-outs, wherein the cut-outs are configured to allow the ribs to enter the cut-outs when two connector housings are aligned in an identical direction so that the concave surface formed on said one side of one of the two connector housings faces the ribs formed on said another side of the other of the two connector housing.

7. A connector unit comprising:

a first connector housing that is the connector housing according to claim 6;

a second connector housing that is the connector housing according to claim 6; and a connecting member configured to fix the first connector housing and the second connector housing together in a condition where the ribs formed on said another side of the second connector housing placed in the cut-outs formed on said one side of the first connector housing.

* * * * *